US009873444B2

(12) United States Patent
Kubo

(10) Patent No.: US 9,873,444 B2
(45) Date of Patent: Jan. 23, 2018

(54) TRAIN SCHEDULING DIAGRAM CORRECTION APPARATUS AND TRAIN SCHEDULING DIAGRAM CORRECTION PROGRAM

(71) Applicants: Kabushiki Kaisha Toshiba, Minato-ku (JP); TOSHIBA SOLUTIONS CORPORATION, Kawasaki-shi (JP)

(72) Inventor: Hideki Kubo, Fuchu (JP)

(73) Assignees: Kabushiki Kaisha Toshiba, Minato-ku (JP); TOSHIBA SOLUTIONS CORPORATION, Kawasaki-shi (JP)

( * ) Notice: Subject to any disclaimer, the term of this patent is extended or adjusted under 35 U.S.C. 154(b) by 0 days.

(21) Appl. No.: 15/350,456

(22) Filed: Nov. 14, 2016

(65) Prior Publication Data

US 2017/0057529 A1 Mar. 2, 2017

Related U.S. Application Data

(63) Continuation of application No. PCT/JP2015/001420, filed on Mar. 13, 2015.

(51) Int. Cl.

| | |
|---|---|
| ***G06F 19/00*** | (2011.01) |
| ***G06G 7/76*** | (2006.01) |
| ***G08G 1/00*** | (2006.01) |
| ***B61L 27/00*** | (2006.01) |

(52) U.S. Cl.

CPC ..... *B61L 27/0094* (2013.01); *B61L 27/0016* (2013.01); *B61L 27/0022* (2013.01); *B61L 27/0027* (2013.01)

(58) Field of Classification Search

None

See application file for complete search history.

(56) References Cited

FOREIGN PATENT DOCUMENTS

| | | |
|---|---|---|
| JP | 6-321111 | 11/1994 |
| JP | 9-123913 | 5/1997 |
| JP | 2005-41332 | 2/2006 |
| JP | 2009-274664 | 11/2009 |
| JP | 2013-23080 | 2/2013 |

OTHER PUBLICATIONS

International Search Report dated Jun. 18, 2015 in PCT/JP2015/001420, filed on Mar. 13, 2015 (with English Translation).

Jun Imaizumi. "Network Flow Model ni yoru Tetsudo no Shutarieki no Noryoku Hyoka", Operations Research, vol. 56, No. 4, Apr. 1 , 2011, pp. 10.

(Continued)

*Primary Examiner* — Bhavesh V Amin

(74) *Attorney, Agent, or Firm* — Oblon, McClelland, Maier & Neustadt, L.L.P.

(57) ABSTRACT

A train scheduling diagram correction apparatus complies earliest and latest timings of a node on a schedule line placed in a shift direction and updates a network diagram by correcting a running hour/minute of the same train between a pair of neighboring trans on the schedule line placed in a schedule line shift direction on the basis of constraint time requirement data of arcs relating to the corresponding nodes in response to shift point information of the schedule line input from an input unit.

5 Claims, 23 Drawing Sheets

(56) References Cited

OTHER PUBLICATIONS

Hideyuki Aisu et al., "Network modeling and planning support of service (Unko no Network Model-ka to Keikaku Sakutei Shien)", Operations Research, vol. 57, No. 8. Aug. 1, 2012, pp. 7 (with English Abstract).

Yusaku Nagasaki et al., "Application of graph theory to scheduling of train operation—fundamental theory and possibility of its application to realtime train rescheduling", TER-03-23, Jun. 2003, pp. 6 (with English Abstract).

Norio Tomii et al., "Scheduling algorithm of a rail—Transit schedule is made with a computer (Tetsudou no Scheduling Algorithm)", 2005, pp. 14 (with English Abstract).

FIG.6

DIAGRAM CORRECTION MODE SETTING SCREEN (A) OPERATION HOUR/MINUTE

REFERENCE OPERATION HOUR/MINUTE APPLICATION MODE

- (●) APPLIED (ON)
- ( ) NOT APPLIED (OFF)

OPERATION HOUR/MINUTE DELAY ALLOWANCE MODE (PRIORITY)

- ( ) ALLOWED (ON)
- (●) NOT ALLOWED (OFF)

(B) PASSING TRAIN SEQUENCE HOLDING MODE

- (●) HELD (ON)
- ( ) NOT HELD (OFF)

(C) TURNAROUND TRAIN SEQUENCE HOLDING MODE

- (●) HELD (ON)
- ( ) NOT HELD (OFF)

(D) DWELL/TURNAROUND HOUR/MINUTE

DWELL HOUR/MINUTE REDUCTION ALLOWANCE MODE

- ( ) ALLOWED (ON)
- (●) NOT ALLOWED (OFF)

TURNAROUND HOUR/MINUTE REDUCTION ALLOWANCE MODE

- ( ) ALLOWED (ON)
- (●) NOT ALLOWED (OFF)

TRAIN SCHEDULING DIAGRAM CORRECTION APPARATUS AND TRAIN SCHEDULING DIAGRAM CORRECTION PROGRAM

CROSS-REFERENCE TO RELATED APPLICATION

This application is a continuation of prior International Application No. PCT/JP2015/001420 filed on Mar. 13, 2005, the entire contents of which are incorporated herein by reference.

FIELD

The present disclosure relates to a train scheduling diagram correction apparatus and a train scheduling diagram correction program.

BACKGROUND

When a timetable for a train or bus system is established, typically, headway times between two stations (standard running nous minute) and dwell times in each station (predefined dwell hour/minute) are determined in advance, and the timetable is created based on such times. In addition, a new timetable for mobiles such as trains is not frequently created. Instead, an existing timetable diagram (hereinafter, referred to as a scheduling diagram) is copied and is then revised on the basis of lessons from experiences. In practice, by repeating the revision, the scheduling diagram is customized.

However, when the scheduling diagram is revised, several problems occur in many cases just by shifting a single schedule line of the scheduling diagram (hereinafter, referred to as a "schedule line"). In particular, this becomes serious when trains are running very densely. Specifically, if a schedule line is shifted in a scheduling diagram visualized on a two-dimensional basis, the schedule lines may overlap with each others, a running sequence may be reversed, or a mismatch problem may occur.

For safe operation of trains, it is necessary to secure sufficient time intervals (headway hour/minute) with preceding and succeeding trains and appropriately maintain intervals between the schedule lines. Furthermore, in order to provide robustness of the scheduling diagram, it is also important to secure a sufficient dwell times or a sufficient layover time at a turnaround station (turnaround layover hour/minute). This is necessary in order to absorb disturbances in the scheduling diagram within the corresponding dwell or layover time. For this reason, generally, in a method of shifting lit a schedule line in a scheduling diagram change work of trains or the like, a reference running hour/minute is not changed basically, and only the dwell or layover time is adjusted.

However, if a dwell time of any train in an intermediate station increases, the increasing time affects the entire scheduling diagram and all other interfering schedule lines, so that a mismatch propagates widely. For this reason, it is desirable to provide a transportation service timetable planner with a rescheduling structure capable of simultaneously shifting other schedule lines by shifting a single schedule line while predefined constant requirements are satisfied.

For example, in the field of train transportation, as a simplified simulation technique, a project evaluation and review technique (PERT) is employed. In addition, a critical path technique is also known to find candidates of schedule lines to be corrected when a delay occurs in the event of a traffic accident. In a significant number of such examples, a method of finding a part that causes violation of the constraint in a chain-reaction manner out of a scheduling scheme such as a train scheduling diagram having various temporal constraints is also employed.

However, in the PERT-based methods knows in the art, only a minimum time interval necessary between events is treated as a constraint. Therefore, they are used limitatively. In the critical path methods, basically, the PERT-based methods are only used in a schedule delay analysis disadvantageously. In the scheduling diagram for mobiles such as trains, it is necessary to shift the schedule lines on the basis of existing running hour/minutes. However, she dwell time in the intermediate station also has a constraint regarding time intervals between events, such as an existing predefined dwell lime conceived as a delay absorption duration and allowance of a minimum dwell time for delay recovery. Therefore, it is also difficult to treat it in the critical path analysis of the PERT known in the art.

BRIEF DESCRIPTION OF THE DRAWINGS

FIG. 6 illustrates a specific example of a diagram correction mode setting screen;

DETAILED DESCRIPTION

Figure 1:
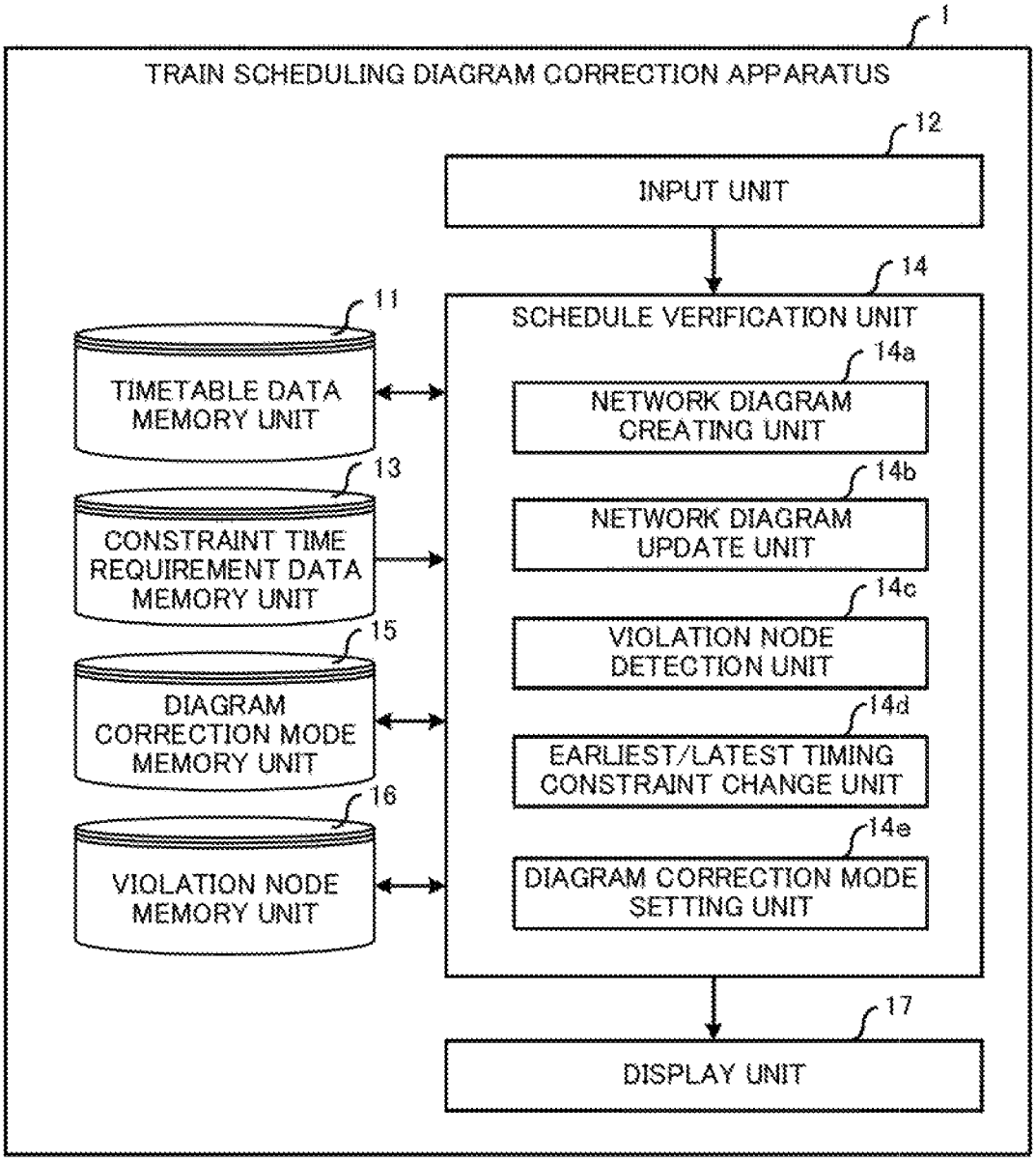
FIG. 1 is a diagram illustrating an exemplary entire configuration of a train scheduling diagram correction apparatus according to an embodiment.

A train scheduling diagram correction apparatus according to the embodiment automatically corrects a scheduling diagram by matching schedule lines on the scheduling diagram.

According to an aspect of the present disclosure, there is provided a train scheduling diagram correction apparatus including; a timetable data memory unit configured to store timetable data relating to a train traveling along a route obtained by linking a plurality of stations; a network diagram creating trait configured to read the timetable data from the timetable data memory unit, create nodes each representing an event relating to arrival and departure of the train in each station, and sequentially connect the nodes using arcs each representing a time interval between the nodes and a time-series arrival-departure sequence in order to create a network diagram for visualizing the timetable data; a display unit configured to display the network diagram created by the network diagram creating unit on a screen, an input unit configured to select one of schedule lines included in the network diagram displayed on the display unit and input shift point information on a time-series sequence, a constraint time requirement data memory unit configured to store minimum and maximum values of the time interval between the nodes as constraint tune requirement data of the arc; and a network diagram update unit configured to correct a continuation headway indicating a tune interval between a pair of the trains traveling along the same direction and a crossover headway indicating a time interval between a pair of the trains traveling oppositely with respect to a terminus station of the route on a schedule line placed in a schedule line shift direction on the basis of the constraint time requirement data relating to the corresponding nodes in response to the shift point information of the schedule line input from the input unit, in order to compute earliest and latest timings of the node on the schedule line placed in the shift direction and update the network diagram.

First, a train scheduling diagram correction apparatus according to the embodiment of a disclosure will be described in brief. The train scheduling diagram correction apparatus according to the embodiment does not automatically create a perfect diagram from the start. but supports a renewal work to assist a user to change an existing scheduling diagram. la general, once a scheduling diagram is modeled in a network format, it is possible to rapidly obtain arrival and departure timings to fulfill all settings of time constraints (including constraints of upper and lower limits of execution timings in each arrival/departure node or constraints of minimum and maximum values of internodal time intervals) as long as the network format does not change. According to this embodiment, such a format is employed. Here, "the network format does not change" means that a constraint is laid on vehicle operation management (method of linking or turning a schedule line), or an arrival/departure sequence and an occupancy priority on the same platform in a station.

A train scheduling diagram correction apparatus 1 according to the embodiment will now be described in detail with reference to the accompanying drawings. FIG. 1 illustrates am entire configuration example of the train scheduling diagram correction apparatus 1. As illustrated in FIG. 1, the train scheduling diagram correction apparatus includes a timetable data memory unit 11, an input unit 12, a constraint time requirement data memory unit 13, a schedule verification unit 14, a diagram correction mode memory unit 15, a violation node memory unit 16, and a display unit 17.

The timetable data memory unit 11 is a memory unit configured to store timetable data (operation schedule data) for trains traveling along a route obtained by linking a plurality of stations. Note that it is assumed that the timetable data memory unit 11 also stores train information and vehicle operation schedule information as the timetable data. The train information contains a unique train serial number as a key, train classification information such as Special Express or Express, and station sequence information such as stopping or passing stations. The station sequence information is a data structure containing a station sequence numbered in ascending order from a start station to a terminus station including stopping and passing stations, station codes for the stations on the station, sequence, classification of passing or stopping stations, arrival timings, and departure timings (only a departure timing is given for the start station, and only an arrival timing is given for the terminus station). Vehicle operation schedule information contains a unique vehicle management number as a key, vehicle model information such as "E233" series, and sequence information on the operated train numbers. The train number sequence information is a data structure containing serial numbers numbered sequentially from shipping on a time basis and train numbers corresponding to the serial numbers.

The input unit 12 includes various input interfaces such as a mouse used to enter information from a user. For example, using the input unit 12, a user selects one of schedule lines included in the network diagram and enters shift point information in a time-series manner on an editing screen displayed on the display unit 17.

The constraint time requirement data memory unit 13 is a memory unit configured to store minimum and maximum time intervals between nodes representing events relating to arrival and departure in each station for a train as constraint time requirement data of the arc that links the events. According to this embodiment, the constraint time requirement data is also referred to as a "weight of arc."

As a schedule (timetable data) for a plurality of events are received from the input unit 12, the schedule verification unit 14 verities whether or not the schedule satisfies the constraint time requirement stored in the constraint time requirement data memory unit 13. The schedule verification unit 14 includes a network diagram creating unit 14*a*, a network diagram update unit 14*b*, a violation node detection unit 14*c*, an earliest/latest timing constraint change unit 14*d*, and a diagram correction mode setting unit 14*e*.

The network diagram creating unit 14*a* reads the timetable data from the timetable data memory unit 11 to create nodes and sequentially connects the nodes using arcs each representing a time interval between the nodes and a time-series arrival/departure sequence to create a network diagram for visualizing the timetable data. In addition, the network diagram creating unit 14*a* selects both minimum and maximum time intervals necessary between the nodes (arc) from the constraint time requirement data as the constraint (weight of arc) when the network diagram is created.

The network diagram update unit 14*b* is a program coded to compute each of the earliest and latest timings of the node on a schedule line placed in a schedule line shift direction based on the constraint time requirement data stored in the constraint time requirement data memory unit 15 in response to information on the schedule line shift point received from the input unit 12 in order to update the network diagram and output the network diagram on the display unit 17. The network diagram update unit 14*b* repeatedly executes computation for correcting upper and lower limits (earliest and latest linings ET and LT) of the execution timing of the event selected on the basis of the constraint time requirement data in each node until each value is converged.

The violation node detection unit 14*c* checks whether or not a magnitude relationship of the earliest and latest timings ET and LT in each node is reversed daring the computation of the earliest and latest timings ET and LT in the network diagram update unit 14*b*. If a node in which the relationship is reversed (ET>LT) is detected. this node is stored as a violation node in the violation node memory unit 16.

In the earliest/latest timing constraint change unit 14*d*, a value obtained by incrementing or decrementing the earliest timing constraint and the latest timing constraint required in the earliest and latest timings ET and LT set in each node of the network diagram by a predefined amount is selected as an initial value of each node. That is, the earliest/latest timing constraint change unit 14*d* sequentially changes the increment or decrement value on the basis of the computation result of the network diagram update unit 14*b*.

The diagram correction mode setting unit 14*e* displays a diagram correction mode setting screen on the display unit 17 in response to the input from the input unit 12 and outputs mode selection information (diagram correction mode information) selected on this screen.

The diagram correction mode memory unit 15 is a memory unit configured to store the diagram correction mode information output from the diagram correction mode setting unit 14*e*.

The violation node memory unit 16 is a memory unit configured to store a violation node detected by the schedule verification unit 14 (violation node detection unit 14*c*). The timetable data memory unit 11, the constraint time requirement data memory unit 13, the diagram correction mode memory unit 15, and the violation node memory unit 10 may be integrated into a single memory unit or may be appropriately distributed across a plurality of memory units.

The display unit 17 is a display device configured to display the network diagram created by the network diagram creating unit 14*a*, the network diagram updated by the network diagram update unit 14*b*. the diagram correction mode setting screen output from the diagram correction mode setting unit 14*e*, and the like.

Figure 2:
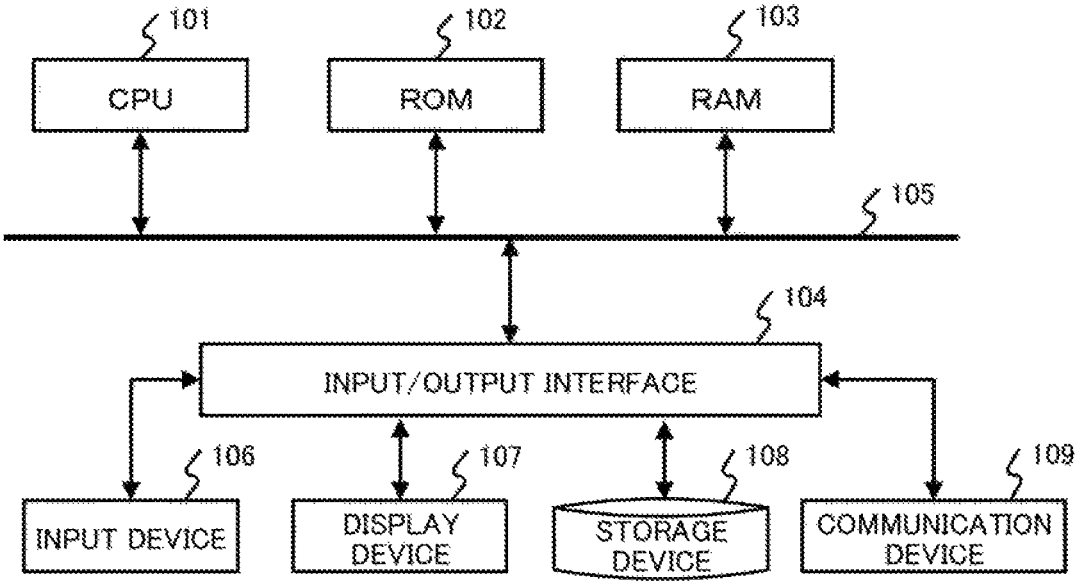
FIG. 2 is a block diagram illustrating an exemplary hardware configuration of the train scheduling diagram correction apparatus of FIG. 1.

FIG. 2 is a block diagram illustrating a hardware configuration example of the train scheduling diagram correction apparatus 1 of FIG. 1. As illustrated in FIG. 2, the train scheduling diagram correction apparatus 1 is a computer including a central processing unit (CPU) 101, a read-only memory (ROM) 102, a random access memory (RAM) 103, an input/output interface 104, a system bus 105, an input device 106, a display device 107, a storage device 108, a communication device 109.

The CPU 101 is a processing device configured to execute various computation processes using programs, data, or the like stored in the ROM 102 or the RAM 103. The ROM 102 is a read-only storage device configured to store basic programs, environmental files, or the like for operating the computer. The RAM 103 is a main storage device configured to store programs executed by the CPU 101 and data necessary in execution of each program and is capable of reading and writing them at a high speed. The input/output interface 104 is a device configured to relay connection between various hardware devices and the system bus 105. The system bus 105 is an information transmission path shared by the CPU 101, the ROM 102, the RAM 103, and the input/output interface 104.

The input/output interface 104 is connected to hardware devices such as the input device 106, the display device 107, the storage device 108, and the communication device 109. The input device 100 is a device configured to process input data from a user, such as a keyboard or a mouse. The display device 107 is a device configured to display computation results, created screens, and the like for a user, such as a liquid crystal display or a plasma display. The storage device 108 is a mass-storage subsidiary memory device configured to store programs or data, such as a hard disc device.

Figure 3:
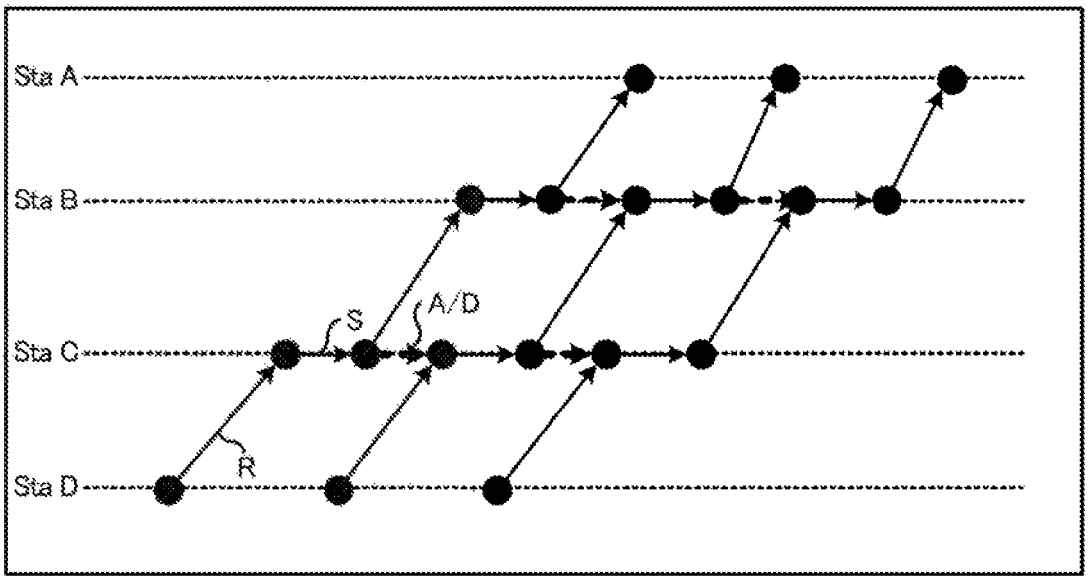
FIG. 3 is a PERT network diagram converted from timetable data.

FIG. 3 illustrates a specific example of a PERT network diagram obtained by visualizing the timetable data (schedule). Each circle indicates a node. In each node. previous timetable timings are set as standard tunings. In addition, as a constraint for a single event, an executable earliest timing ET (lower limit timing) constraint and an executable latest timing LT (upper limit timing) constraint are added from the constraint time requirement data.

The arrow indicates an "arc." The arc is generally classified into three types. The arc R expressed by the solid-line arrow is connected between a departure node of each station (hereinafter, also referred to as a "departure node") and an arrival node of the next station (hereinafter, also referred to as an "arrival node") to visualize a travel between stations and is also called an "inter-station arc." In addition, the arc S expressed by the solid-line arrow is connected between an arrival node and a departure node in each station to visualize a station stop and is called a "stopping arc." In addition, the arc A/D expressed by the dashed line is an arc for visualizing the order of trains In the same station and is called an "arrival/departure sequence arc."

In each arc, a difference of the timing set in the original schedule diagram (difference between the standard timings set in the departure node and the arrival node) is set as a standard headway between events, in addition, as a time constraint requirement fulfilled between events, minimum and maximum time intervals are applied on the basis of the constrains time requirement data.

Figure 4:
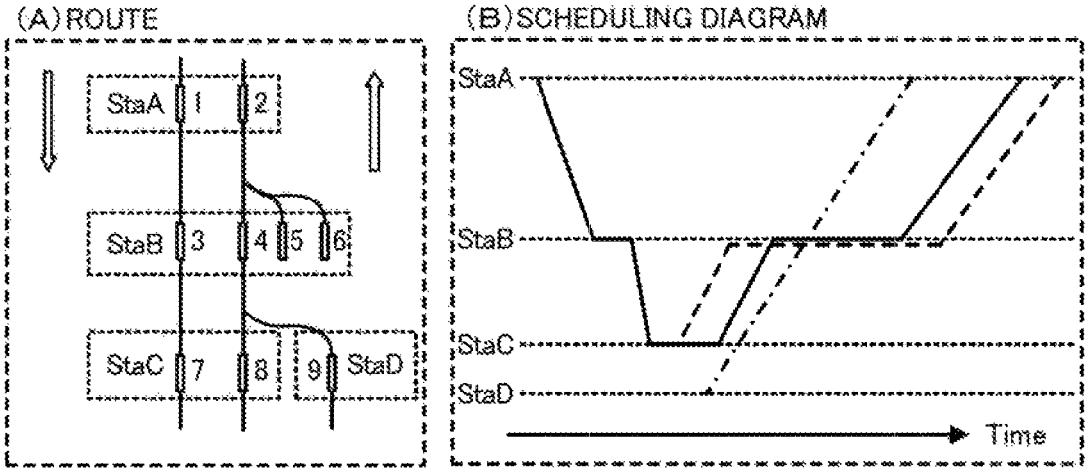
FIG. 4 illustrates a specific example of a relationship between routes and timetable data.

FIG. 4 illustrates a specific example of a relationship between the tomes and the 20 timetable data, in FIG. 4A, each station A, B, and C has a plurality of platforms. In FIG. 4B, timetable data of three trains traveling along the routes of FIG. 4A are plotted. For example, the schedule line expressed by the solid line visualizes a movement of the train that departs from station A, stops at station B, and is turned around oppositely at station C.

Figure 5:
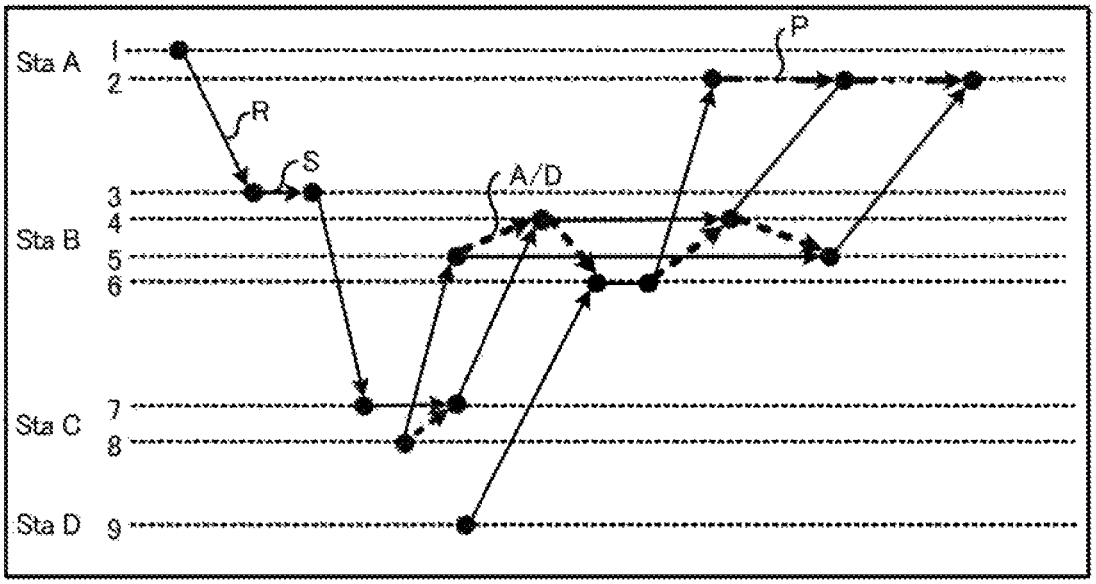
FIG. 5 is a PERT network diagram converted from the routes and timetable data of FIG. 4.

FIG. 5 is a PERT network diagram obtained by modeling the routes and the timetable data of FIG. 4 in a network format. Here, similar to FIG. 3, a plurality of arrival/departure nodes and arcs obtained by linking the nodes are illustrated in the network diagram. Unlike FIG. 3, each station A to C has a plurality of platforms, and the nodes and the arcs are set for each platform. In addition, the arc P expressed by the two-dotted chain line is included. The arc P is an arc for visualizing the dwelling/passing order in the same platform of each station, and is called a "platform sequence arc" in this embodiment. Similar to other types of arcs, in the platform sequence arc P, minimum and maximum lime intervals are applied as a time constraint requirement fulfilled between events on the basis of the constraint time requirement data.

Next, basic timing information set as weights of various arcs when the network diagram of FIG. 5 is displayed on the screen will be described.

(1) Reference Operation Hour/Minute

A reference value of the operation time necessary to move from a station to another is called a "reference operation hour/minute." This reference operation hour/minute is calculated by plotting a normal driving curve and performing simulation. If a vehicle, is changed, performance of the vehicle is also changed. Therefore, the simulation results in some deviations. Typically, a slowest vehicle is assumed in the simulation to obtain a reference operation hour/minute allowed for all vehicles. If trains are operated very densely as in the Japan metropolitan railways, all trains are operated at this reference operation hour/minute to increase the operation density. According to embodiments, the "hour/minute" refers to a time also including seconds.

The "reference operation hour/minute" refers to the constraint time requirement data used as a weight of the inter-station arc. The reference operation hour/minute is data basing a formal {Line Classification, Running Direction, Start Station, Terminus Station} as a unique key. Specifically, the reference operation hour/minute has the following data structure.

TABLE 1-1

| Line Classification | Running Direction | Start Station | Terminus Station | Reference Operation Hour/Minute |
|---|---|---|---|---|
| αLine | Z Station Direction | A Station | B Station | 2:40 |
| αLine | Z Station Direction | B Station | C Station | 3:30 |
| αLine | Z Station Direction | C Station | D Station | 2:50 |

Although the reference operation hour minute is expressed in the unit of {Line Classification, Running Direction, Start Station, Terminus Station} in the aforementioned description, it may be more strictly defined by further considering the platform, to this case, the following data structure may be employed.

TABLE 1-2

| Line Classification | Running Direction | Start Station | Start Station Line | Terminus Station | Terminus Station Line | Reference Operation Hour/Minute |
|---|---|---|---|---|---|---|
| α Line | Z Station Direction | A Station | 1 | B Station | 1 | 2:40 |
| α Line | Z Station Direction | A Station | 1 | B Station | 2 | 2:40 |
| α Line | Z Station Direction | A Station | 2 | B Station | 1 | 2:50 |
| α Line | Z Station Direction | A Station | 2 | B Station | 2 | 2:50 |
| α Line | Z Station Direction | B Station | 1 | C Station | 1 | 3:30 |
| α Line | Z Station Direction | B Station | 2 | C Station | 1 | 3:40 |
| α Line | Z Station Direction | C Station | 1 | D Station | 1 | 2:50 |

(2) Minimum (Standard) Dwell Hour/Minute

A dwell time in any station is predefined to a normally necessary minimum time. This is called a "minimum (standard ) dwell hour/minute." Most of the trains are operated to fulfill this dwell time. The dwell time may be delayed intentionally for train transfer in the same station. If a delay occurs, it may be reduced to the minimum (standard) dwell hour/minute. In addition, since the dwell time depends on the number of boarding or alighting passengers, evaluation of the dwell time may be changed depending on a time block, and the minimum (standard) dwell hour/minute may be changed accordingly. In general, this minimum (standard) dwell hour-minute is defined for each running direction. The minimum (standard) dwell hour minute is one of the constraint time requirement data used as a weight of the stopping arc and has a unique key in the form of {Line Classification, Running Direction, Station}. In this case, the following structure may be employed.

TABLE 2-1

| Line Classification | Running Direction | Station | Minimum (Standard) Dwell Hour/Minute |
|---|---|---|---|
| αLine | Z Station Direction | A Station | 0:40 |
| αLine | Z Station Direction | B Station | 0:30 |
| αLine | Z Station Direction | C Station | 0:30 |

Although the minimum (standard) dwell hour/minute is set in the unit of {Line Classification, Running Direction, Station} in the aforementioned description, it may be defined more strictly by further considering the platform. In this case, the minimum (standard) dwell hour/minute has the following structure.

TABLE 2-2

| Line Classification | Running Direction | Station | Platform | Minimum (standard) Dwell Hour/Minute |
|---|---|---|---|---|
| αLine | Z Station Direction | A Station | 1 | 0:30 |
| αLine | Z Station Direction | A Station | 2 | 0:40 |
| αLine | Z Station Direction | B Station | 1 | 0:30 |

(3) Minimum Turnaround Layover Hour/Minute

An hour/minute required for a train to arrive at a terminus station, turn around, and then depart therefrom is referred to as a "minimum turnaround layover hour/minute." This turnaround layover hour/minute is arbitrarily defined on the basis of a relationship between scheduled trains. In order to improve robustness of the scheduling diagram for a train delay, it is important to increase this turnaround layover time because it is easy to absorb a train delay using this layover time and restore the scheduled timetable. Even when the turnaround layover time is reduced, there is a minimum necessary layover time. This minimum necessary layover time is referred to as a "minimum turnaround layover hour/minute." The minimum turnaround layover hour/minute is one of the constraint time requirement data used as a weight of the stopping arc and has a unique key in the form of {Line Classification, Running Direction, Station}. Its data structure is expressed as follows.

TABLE 3-1

| Line Classification | Running Direction | Station | Minimum Turnaround Layover Hour/Minute |
|---|---|---|---|
| αLine | Z Station Direction | A Station | 0:40 |
| αLine | Z Station Direction | B Station | 0:30 |
| αLine | Z Station Direction | C Station | 0:30 |

Although the minimum turnaround layover hour/minute is expressed in the unit of {Line Classification, Running Direction, Station} in the aforementioned description, it may be defined more strictly by further considering the platform. In this case, the following data structure may be possible.

TABLE 3-2

| Line Classification | Running Direction | Station | Platform | Minimum Turnaround Layover Hour/Minute |
|---|---|---|---|---|
| αLine | Z Station Direction | A Station | 1 | 0:30 |
| αLine | Z Station Direction | A Station | 2 | 0:40 |
| αLine | Z Station Direction | B Station | 1 | 0:30 |

(4) Headway Hour/Minute

A time interval for guaranteeing safe operations with preceding and succeeding trains in the event of arrival or departure at a station is referred to as a "headway hour/minute." The preceding and succeeding trains may pass through a railroad switch in the event of arrival or departure at a station. In this case, it is necessary to provide a train headway longer than a railroad switch operation time. In addition, when a stopping train and a passing train are mixed, a speed difference is generated between trains. Therefore, the two trains approach each other. For this reason, it is necessary to secure a time interval (headway hour/minute) such that the trains do not approach even when a speed difference exists. The headway hour/minute includes a "continuation headway" indicating a time interval between trains traveling along the same direction and a "turnaround headway (crossover headway)" indicating a time interval between trains traveling oppositely, for example, between arrival and departure trains at a terminus station. In addition, since the railroad switch is provided in both ends of the station, the headway hour/minute is defined for both ends of the station, and the number of headway hour/minutes depends on the number of combinations of arrival, departure, and passing.

4-1) Types of Continuation Headway

The continuation headway is defined for both ends of a station, and there are combinations of passing and stopping of preceding and succeeding trains. In the combination, three patterns including "arrival," "departure," and "passing" are defined. Typically, the arrival is expressed as "A," the departure is expressed as "D," and the passing is expressed as "P." For example, if a preceding train arrives, and a succeeding train passes, the headway is expressed as "A-P headway." The continuation headway hour/minute is one of the constraint time requirement data used as weights of the arrival/departure sequence arc and the platform sequence arc and has a unique key in the form of {Line Classification, Running Direction, Station, Combination Pattern of Preceding/Continuation}. Its data structure is expressed as follows.

TABLE 4-1

| Line Classification | Running Direction | Station | Combination Pattern of Preceding/ Continuation | Continuation Headway Hour/Minute |
|---|---|---|---|---|
| αLine | Z Station Direction | A Station | A-A | 2:40 |
| αLine | Z Station Direction | A Station | A-D | 2:30 |
| αLine | Z Station Direction | A Station | A-P | 2:30 |
| αLine | Z Station Direction | A Station | D-A | 2:40 |
| αLine | Z Station Direction | A Station | D-D | 2:20 |
| αLine | Z Station Direction | A Station | D-P | 2:30 |
| αLine | Z Station Direction | A Station | P-A | 2:20 |
| αLine | Z Station Direction | A Station | P-D | 2:30 |
| αLine | Z Station Direction | A Station | P-P | 2:30 |
| αLine | Z Station Direction | B Station | A-A | 2:50 |
| αLine | Z Station Direction | B Station | A-D | 2:30 |

Although the continuation headway described above is defined in the unit of {Line Classification, Running Direction, Station, Combination Pattern of Preceding/Continuation}, it may be defined more strictly by further considering the platform. In this case, the following data structure may be possible.

TABLE 4-2

| Line Classification | Running Direction | Station | Preceding Train Platform | Preceding Train | Succeeding Train Platform | Succeeding Train | Continuation Headway Hour/Minute |
|---|---|---|---|---|---|---|---|
| α Line | Z Station Direction | A Sta | 1 | A | 1 | A | 2:40 |
| α Line | Z Station Direction | A Sta | 1 | A | 2 | A | 2:30 |
| α Line | Z Station Direction | A Sta | 2 | A | 1 | A | 2:30 |
| α Line | Z Station Direction | A Sta | 2 | A | 2 | A | 2:40 |
| α Line | Z Station Direction | A Sta | 1 | A | 1 | D | 2:20 |
| α Line | Z Station Direction | A Sta | 1 | A | 2 | D | 2:30 |

(4-2) Types of Turnaround Headway (Crossover Headway)

Generally, the turnaround headway is given to a direction not to the termination end side of the terminus station. If a turnaround train exists even in an intermediate station, the turnaround headway is also defined. In addition, the turnaround headway is defined for combinations of passing and stopping of preceding and succeeding turnaround trains. In the combination, two patterns including "arrival" and "departure" are defined. In the case of a passing station, three patterns including "arrival," "departure," and "passing" are defined. Typically, the arrival is expressed as "A," the departure is expressed as "D," and the passing is expressed as "P."

For example, if a preceding train arrives, and a succeeding train departures, the turnaround headway is expressed as "arrival-departure turnaround headway."

The turnaround headway (crossover headway) hour/minute is one of the constraint time requirement data used as weights of the arrival/departure sequence arc and the platform sequence arc and has a unique key in the form of {Line Classification, Running Direction, Station, Preceding/Continuation Combination. Pattern, Turnaround Headway Hour/Minute}. Its data structure is expressed as follows.

TABLE 5-1

| Line Classification | Running Direction | Station | Combination Pattern of Preceding/ Continuation | Turnaround Headway Hour/Minute |
|---|---|---|---|---|
| αLine | Z Station Direction | A Station | A-D | 2:40 |
| αLine | Z Station Direction | A Station | D-A | 2:30 |
| αLine | Z Station Direction | B Station | A-D | 2:50 |
| αLine | Z Station Direction | B Station | D-A | 2:30 |
| αLine | Z Station Direction | C Station | A-D | 2:50 |
| αLine | Z Station Direction | C Station | D-A | 2:30 |

Although the turnaround headway described above is defined in the unit of {Line Classification, Running Direction, Station, Preceding/Continuation Combination Pattern, Turnaround Headway Hour/Minute}, it may be defined more strictly by further considering the platform. In this case, the following data structure may be possible.

TABLE 5-2

| Line Classification | Running Direction | Station | Preceding Train Platform | Preceding Train | Succeeding Train Platform | Succeeding Train | Turnaround Headway Hour/Minute |
|---|---|---|---|---|---|---|---|
| α Line | Z Station Direction | A Sta | 1 | A | 1 | D | 2:20 |
| α Line | Z Station Direction | A Sta | 1 | A | 2 | D | 2:40 |
| α Line | Z Station Direction | A Sta | 2 | A | 1 | D | 2:40 |
| α Line | Z Station Direction | A Sta | 2 | A | 2 | D | 2:20 |
| α Line | Z Station Direction | A Sta | 1 | D | 1 | A | 2:20 |
| α Line | Z Station Direction | A Sta | 1 | D | 2 | A | 2:40 |

Next, a diagram correction mode predefined by a user as a prerequisite for the processing in the network diagram update unit 14*b* will be described. FIG. 6 illustrates a specific example of a diagram correction mode setting screen. This screen is displayed on the display unit 17 by the diagram correction mode setting unit 14*e*. Here, it is recognized that six diagram correction modes can be set on the screen. A user may change a schedule line movement (correction pattern) in the diagram editing work by changing the setting of the diagram correction mode. This is because a value of the weight of the arc given in the event of creation of the network diagram is changed, and a constraint is applied in the event of the shift of the schedule line. For example, the value set for the arc may be changed as follows by selecting (applying, holding, or allowing) or deselecting (unapplying, releasing, or disallowing) each mode.

(1) Reference Operation Hour/Minute Application Mode

When selected (applied): Whatever train is (regardless of whether or not a train fulfills the reference operation hour/minute), an inclination of the schedule line is computed to fulfill a constraint obtained by compulsorily applying the inter-station reference operation hour/minute. That is, the reference operation hour/minute is applied to overall trains.

When deselected (not applied): The inclination of the schedule line is computed to fulfill a constraint of the inter-station operation hour/minute on the current diagram. That is, the current operation hour/minute is directly applied.

(2) Operation Hour/Minute Delay Allowance Mode

When selected (allowed): Regardless of selection-deselection of the reference operation hour/minute application mode, the computation is performed by removing the constraint on the operation hour/minute and allowing a delay of the operation hour/minute.

When deselected (disallowed): The computation is performed by fulfilling the constraint of the reference operation hour/minute or the inter-station operation hour/time on the current diagram.

(3) Passing Train Sequence Molding Mode

When selected (held): The computation is performed by holding a passing sequence of the passing and Stopping trains at the corresponding station.

When deselected (not held): The computation is performed by freely exchanging passing and stopping trains regardless of the passing sequence at the corresponding station.

(4) Turnaround Train Sequence Holding Mode

When selected (held): The computation is performed by holding the arrival/departure sequences of the arrival and departure trains at the corresponding station.

When deselected (not held): The computation is performed by freely exchanging arrival and departure trains regardless of the arrival/departure sequence at the corresponding station.

(5) Dwell Time Reduction Allowance Mode

When selected (allowed); The dwell time is computed to fulfill a minimum (standard) dwell rime predefined for each station to be shorter than the dwell time of the current diagram.

When deselected (disallowed): The dwell time is computed to fulfill the dwell time of the current diagram.

(6) Turnaround Tune Reduction Allowance Mode

When selected (allowed): The turnaround time is computed to fulfill the minimum turnaround layover hour/minute predefined for each station to be shorter than the turnaround time of the current diagram.

When deselected (disallowed): The turnaround time is computed to fulfill the current turnaround time Next operations of the train scheduling diagram correction apparatus 1 according to the embodiment will be described.

<Network Diagram Creation Process>

Figure 7:
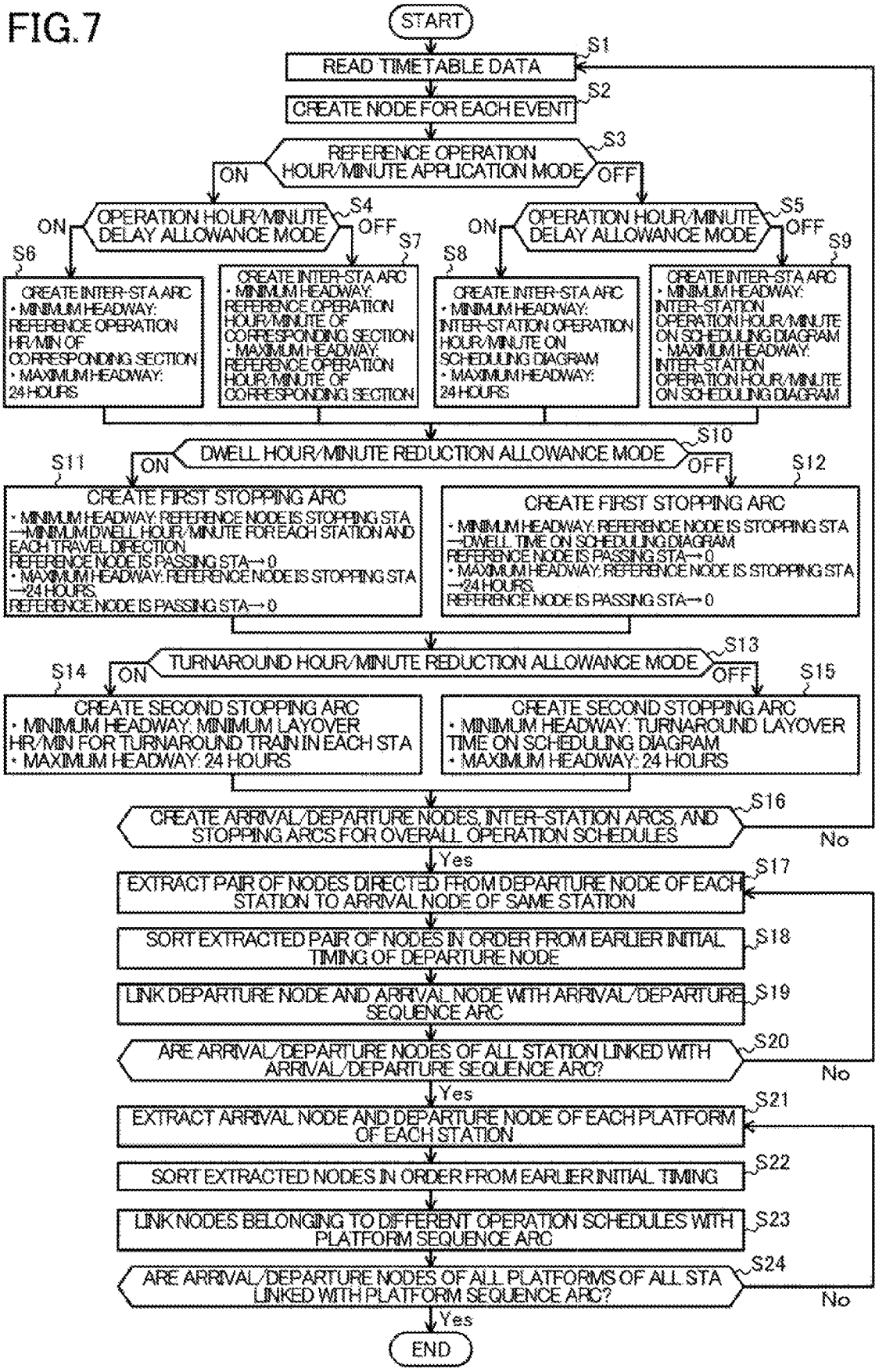
FIG. 7 is a flowchart illustrating a specific example of a network diagram creating process using a network diagram creating unit of FIG. 1.

FIG. 7 is a flowchart illustrating a specific example of a network diagram creation process in the network diagram creating unit 14*a*. This process starts as a user requests display of the current network diagram.

First, as the timetable data is read depending on the operation of the schedule n (step S1), the network diagram creating unit 14*a* creates arrival and departure nodes for every operation event (step S2).

Then, the network diagram creating unit 14*a* determines whether or not the reference operation hour/minute application mode is selected by referencing the diagram correction mode memory unit 15 (step S3). Here, if the reference operation hour/minute application mode is selected (ON in step S3), the process advances to step S4. Otherwise, if the reference operation hour/minute application mode is deselected (OFF in step S3), the process advances to step S5.

In step S4, the network diagram creating, unit 14*a* determines whether or not the operation hour/minute delay allowance mode is selected by referencing the diagram correction mode memory unit 15. Here, if the operation hour/minute delay allowance mode is selected (ON in step S4). the inter-station arc is created using the following condition (step S6), and the process advances to step S10. According to this embodiment, the inter-station arc is an arc connected from a departure node (departure timing node) of a certain station to an arrival node (arrival timing node) of the next station of the same train.

[Inter-station Arc Creation Condition (1)]

Minimum headway: reference operation hour/minute of corresponding block

Maximum headway: twenty four hours

Otherwise, if the operation hour-minute delay allowance mode is deselected (OFF in step S4), the inter-station arc is created using the following condition (step S7), and the process advances to step S10.

[Inter-Station Arc Creation Condition (2)]

Minimum headway: reference operation hour/minute of corresponding block

Maximum headway: reference operation hour/minute of corresponding block

In step S5, the network diagram creating unit 14*a* determines whether or not the operation hour/minute delay allowance mode is selected by referencing the diagram correction mode memory unit 15. Here, if the operation hour/minute delay allowance mode is selected (ON in step S5), the inter-station arc is created using the following condition (step SB), and the process advances to step S10.

[Inter-station Arc Creation Condition (3)]

Minimum headway: inter-station operation hour/minute on scheduling diagram

Maximum headway: twenty four hours

Otherwise, if the operation hour/minute delay allowance mode is deselected (OFF in step S5), the inter-station arc is created using the following condition (step S9), and the process advances to step S10.

[Inter-station Arc Creation Condition (4)]

Minimum headway: Inter-station operation hour-minute on scheduling diagram

Maximum headway: inter-station operation hour/minute on scheduling diagram

In step S10, the network diagram creating unit 14*a* determines whether or not the dwell hour/minute reduction allowance mode is selected by referencing the diagram correction mode memory unit 15. Here, if the dwell hour/minute reduction allowance mode is selected (ON in step S10), a first stopping arc is created using the following condition (step S11), and the process advances to step S13. According to this embodiment, the first stopping arc is an arc connected from an arrival node (arrival tuning node) to a departure node (departure timing node) of the same train at the same station.

[First Stopping Arc Creation Condition (1)]

Minimum headway: set to a minimum dwell hour/minute for each travel direction at each station if a reference node relates to a stopping station, or set to zero if the reference node relates to a passing station.

Maximum headway; set to twenty four hours If the reference node relates to a stopping station, or set to zero if the reference node relates to a passing station.

Otherwise, if the stopping hour/minute reduction allowance mode is deselected (OFF in step S10), the first stopping arc is created using the following condition (S12), and the process advances to step S13.

[First Stopping Arc Creation Condition (2)]

Minimum headway: set to the dwell time on the current diagram if the reference node relates to a stopping station, or set to zero if the reference node relates to a passing station.

Maximum headway: set to twenty four hours if the reference node relates to a stopping station, or set to zero if the reference node relates to a passing station.

In step S13, the network diagram creating unit 14*a* determines whether or not the turnaround hour/minute reduction allowance mode is selected by referencing the diagram correction mode memory unit 15. Here, if the turnaround hour/minute reduction allowance mode is selected (ON in step S13), the second stopping arc is created using the following condition (step S14), and the process advances to step S16. According to this embodiment, the second stopping arc is an arc connected from a last-run arrival timing node of a train included in a single vehicle operation schedule to a first-run departure timing node of another train of the same station included in the same vehicle operation schedule.

[Second Stopping: Arc Creation Condition (1)]

Minimum headway: set to a minimum dwell hour/minute for a turnaround train at each station.

Maximum headway: set to twenty four hours.

Otherwise, if the turnaround hour/minute reduction allowance mode is deselected (OFF in step S13), the second stopping arc is created using the following condition (step S15), and the process advances to step S16.

[Second Stooping Arc Creation Condition (2)]

Minimum headway: set to the turnaround layover time on the current diagram

Maximum Headway: twenty four hours

In step S16, the network diagram creating unit 14*a* determines whether or not creation of the arrival/departure nodes, the inter-station arc, and the stopping arcs for the entire operation schedule is completed. Here, if creation of the nodes, the inter-station arcs, and the stopping arcs for the entire operation schedule is completed (YES in step S16), the process advances to step S17. Otherwise, if creation of the nodes, the inter-station arcs, and the stopping arcs for the entire operation schedule is not completed (NO in step S16), the process returns to step S1.

In step S17, the network diagram creating unit 14*a* searches all of the created nodes to extract pairs of nodes directed from the departure node of each station to the arrival node of the same station. In addition, the pairs of nodes are sorted in order from the earlier initial tinting (standard timing) of the departure node (step S18). Along the sorted order, the departure and arrival nodes are connected with the created arrival/departure sequence arc (step S19). Note that, when trains depart from the same station and are destined to different stations, they travel through different tracks. Therefore, an arc is not connected between each other A method of creating the arrival/departure sequence arc will be described below in more detail.

Next, the network diagram creating unit 14*a* determines whether or not connection of arrival/departure nodes of all stations is completed using the arrival/departure sequence arc (step S20). Here, if connection of arrival/departure nodes of all stations is completed using the arrival/departure sequence arc (YES in step S20), the process advances to step S21. Otherwise, if the connection is not completed (NO in step S20), the process returns to step S17.

Then, the network diagram creating unit 14*a* searches all of the created nodes to extract arrival and departure nodes in each platform of each station (step S21). The nodes are sorted in order from the earlier initial timing (standard timing) (step S22). Along the sorted order, the nodes belonging to different operation schedules are connected to each other using the created platform sequence arc (step S23). A method of creating the platform sequence arc will be described below in more detail.

Then, the network diagram creating unit 14*a* determines whether or not arrival/departure nodes in all platforms of all stations are completely connected using the platform sequence arc (step S24). Here, if arrival/departure nodes of all platforms of all stations are completely connected using the platform sequence arc (YES in step S24), the process is terminated. Otherwise, if the connection is not completed (NO in step S24), the process returns to step S21.

Next, creation of nodes and arcs will be described in more detail.

1. Creation of Nodes

Figure 8:
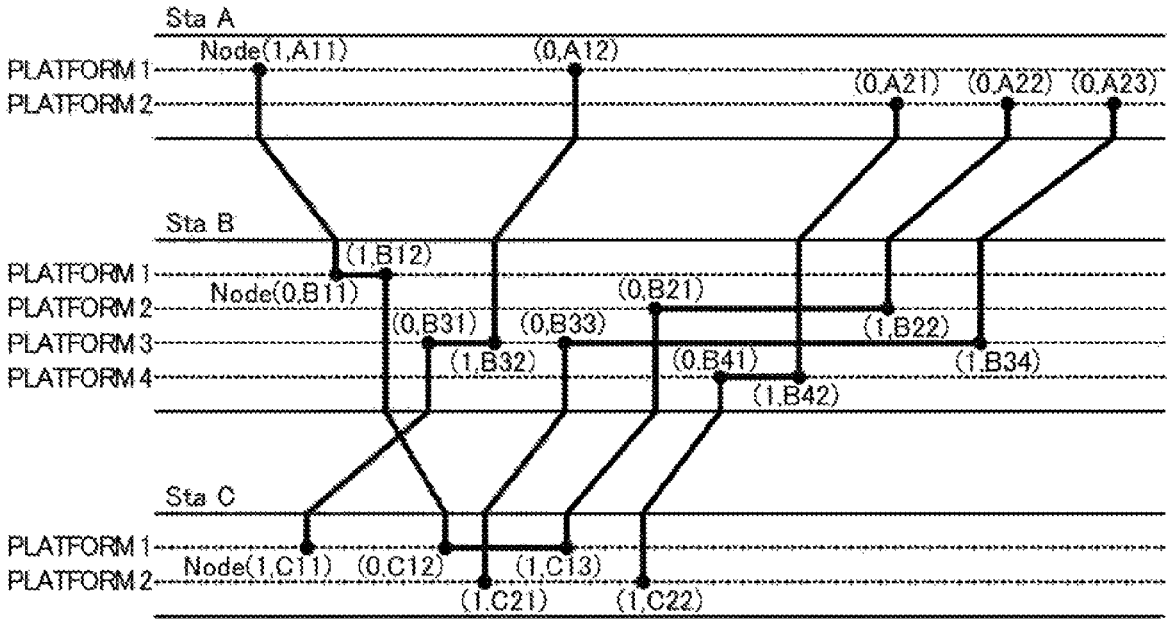
FIG. 8 illustrates creation of nodes.

FIG. 8 illustrates creation of nodes. Mere, the arrival node is created in the form of "Node (0, node ID)" for each arrival timing point, and the departure node is created in the form of "(Node (1, node ID)" for each departure timing point. For example, an initial departure node in Platform 1 of Station A is expressed as "Node (1, A11)," and an arrival node of the same train in Platform 1 of Station B is expressed as "Node (0, B11)."

Note that a value of the weight of the node is set in the following way.

Earliest timing (Et): set to the arrival timing set in the timetable data for the arrival node, or set to the departure timing for the departure node.

Earliest timing constraint: set to a minimum operable timing (for example, 3:00:00).

Latest timing constraint: set to a maximum operable timing (for example, 27:00:00).

2. Inter-Station Arc

Figure 9:
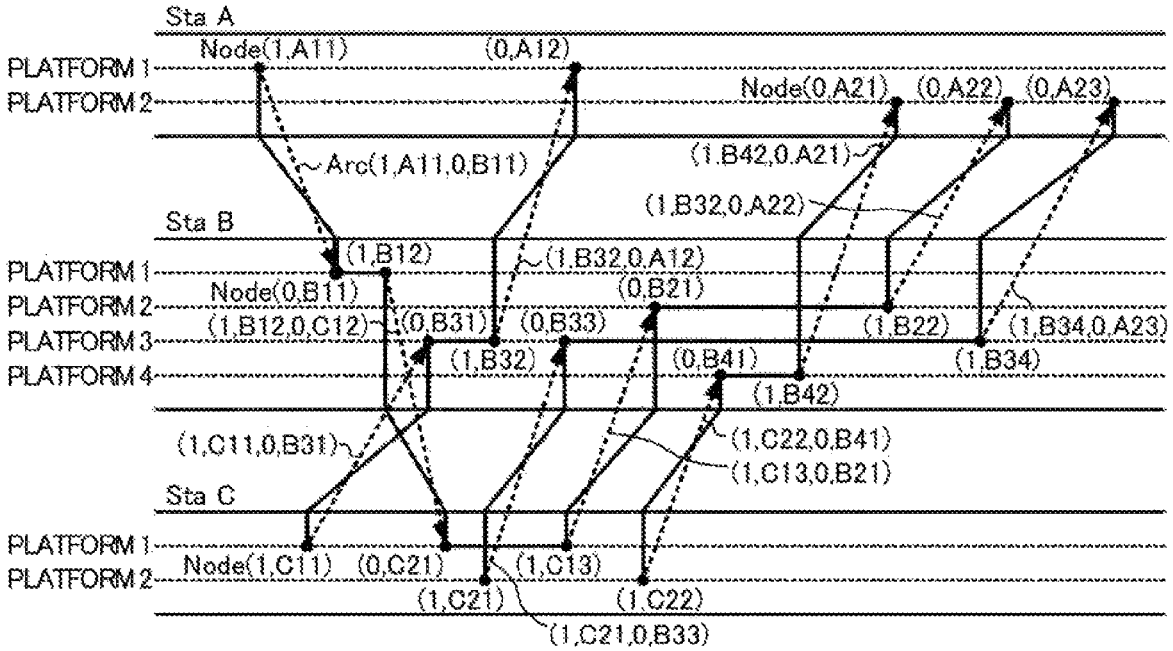
FIG. 9 illustrates creation of an inter-station arc.

FIG. 9 illustrates creation of an inter-station arc. The inter-station arc is an arc connected from a departure tuning node of the same train in a certain station to an arrival timing node in the next station. The inter-station arc is created by setting a departure timing of a certain station as a reference (link origin) node and setting an arrival timing of the next stopping station of the same train (set to the departure timing if the train passes through the next station) as a link destination node on the basis of the timetable data. In FIG. 9, the dashed-line arrow indicates the inter-station arc. In addition, the inter-station arc is expressed in the form of "Arc (1, reference node ID (departure), 0, link destination node ID (arrival))." For example, the inter-station arc that links the departure node A11 of Platform 1 of Station A and the arrival node B11 of Platform 1 of Station B is expressed as "Arc (1, A11, 0, B11)."

Note that each value of the weight of the inter-station arc is set as follows.

(1) If both the reference operation hour/minute application mode and the operation hour-minute delay allowance mode are selected:

Minimum headway: set to the reference operation hour minute predefined for a section corresponding to the arc.

Maximum headway: set to the maximum operable time (for example, twenty four hours).

(2) If the reference operation hour/minute application mode is selected, and the operation hour/minute delay allowance mode is deselected:

Minimum headway: set to the reference operation hour/minute predefined for a section corresponding to the arc.

Maximum headway: set to the reference operation hour/minute predefined for a section corresponding to the arc.

(3) If the reference operation hour/minute application mode is deselected, and the operation hour/minute delay allowance mode is selected.

Minimum headway: set to an inter-station operation hour/minute taken for a train to travel through the section corresponding to the arc on the scheduling diagram, Maximum headway: set to the maximum operable time (for example, twenty four hours).

(4) If both the reference operation hour/minute application mode and the operation hour/minute delay allowance mode are deselected:

Minimum headway: set to an inter-station operation hour/minute taken for a train to travel through the section corresponding to the arc on the scheduling diagram.

Maximum headway: set to an inter-station operation hour/minute taken for a train to travel through the section corresponding to the arc on the scheduling diagram.

3. Creation of Stopping Arc

Figure 10:
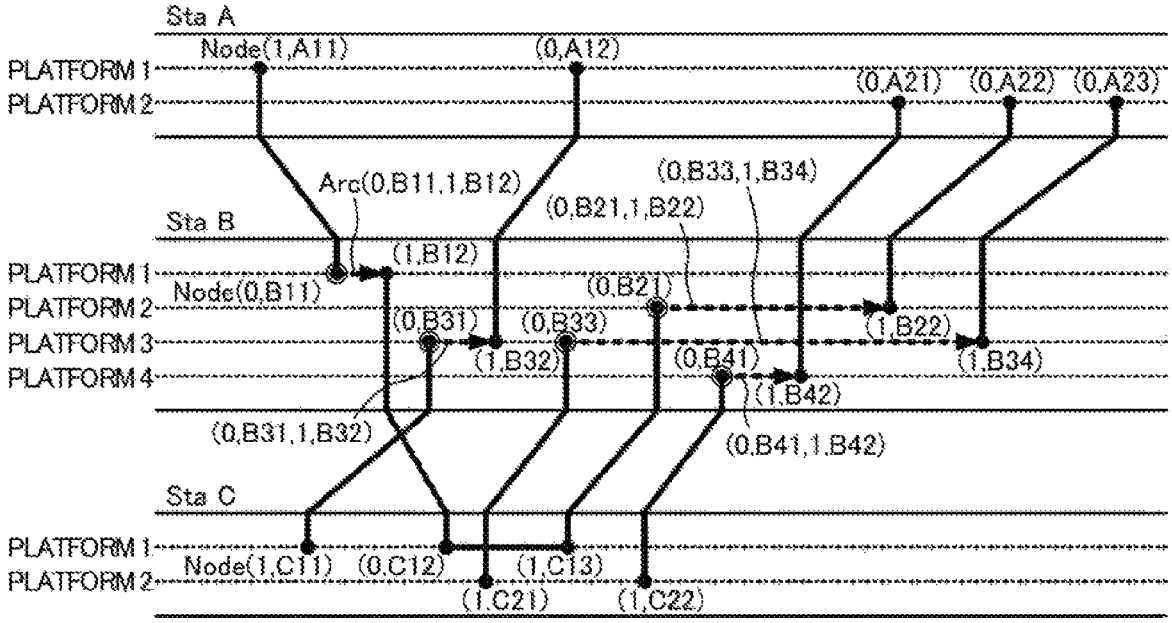
FIG. 10 illustrates creation of a first stopping arc.

Subsequently, a stopping arc will be described. According to this embodiment, the stopping arc is classified into two types. FIG. 10 illustrates creation of a first stopping arc. The first stopping arc is an arc connected from an arrival timing node of a certain station of the same train to a departure timing node of the same station. The first stopping arc is created by setting an arrival timing of a certain station as a reference node and setting the next departure timing of the same train as a link destination node on the basis of the timetable data. The first stopping arc for a passing station is created similarly. In FIG. 10, the dashed-line arrow indicates the first stopping arc. In addition, in FIG. 10, the first stopping arc is expressed in the form of "Arc (0, reference node ID (arrival), 1, link destination node ID (departure))." For example, the first stopping arc that links the arrival node B11 of Platform 1 of Station B and the departure node B12 of Platform 1 of Station B is expressed as "Arc (0, B11, 1, B12)."

Note that each value of the weight of the first stopping arc is set as follows.

(1) If the dwell time reduction allowance mode is selected:

Minimum headway: set to a master setup value of the minimum dwell hour/minute of the same travel direction predefined for each station if the reference node belongs to a stopping station, or set to zero if the node belongs to a passing station.

Maximum headway: set to a maximum operable time (for example, twenty four hours). If the node belongs to a passing station, set to zero.

(2) If the dwell time reduction allowance mode is deselected:

Minimum headway: set to the dwell time on the existing scheduling diagram if the reference node belongs to a stopping station. If the node belongs to a passing station, set to zero.

Maximum headway: set to the maximum operable time (for example, twenty four hours), if the node belongs to a passing station, set to zero.

Figure 11:
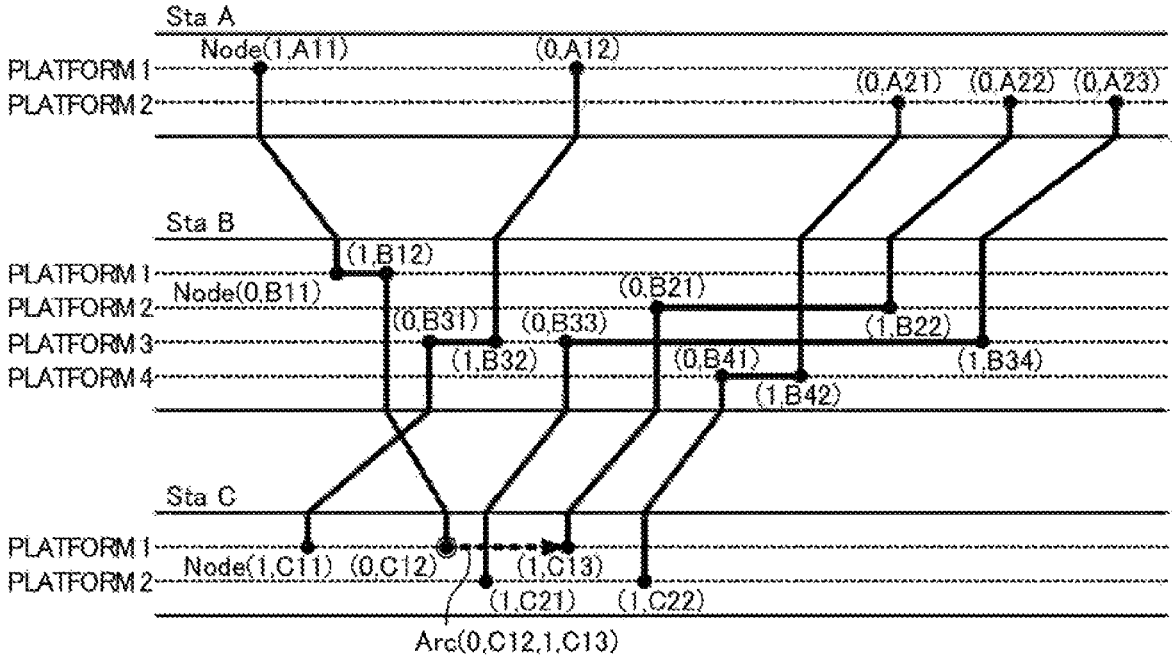
FIG. 11 illustrates creation of a second stopping arc.

FIG. 11 illustrates creation of a second stopping arc. The second stopping arc is an arc connected from a last-run arrival timing node of a certain train included in a single vehicle operation schedule to a first-run departure timing node of another train of the same station included in the same vehicle operation schedule. The second stopping arc is created by setting the last-run arrival timing as a reference node and setting the next first-ran departure timing of another train as a link destination node on the basis of the timetable data and the vehicle operation schedule information. In FIG. 11, the dashed-tine arrow indicates the second stopping arc. In addition, the second stopping arc is expressed in the form of "Arc (0, reference node ID (arrival), 1, link destination node ID (departure))." For example, the second stopping arc that links the arrival node C12 of Platform 1 of Station C and the departure node C13 of Platform 1 of Station C is expressed as "Arc (0, C12, 1, C13)"

Note that each value of the weight of the second stopping arc is set as follows.

(1) If the turnaround time reduction allowance mode is selected:

Minimum headway, set to a minimum turnaround train layover hour minute predefined for each station.

Maximum headway: set to the maximum operable time (for example, twenty four hours).

(2) If the turnaround time reduction allowance mode is deselected:

Minimum headway: set to the turnaround layover time on the existing scheduling diagram.

Maximum headway: set to the maximum operable time (for example, twenty four hours).

4. Creation of Arrival/Departure Sequence Arc

Figure 12:
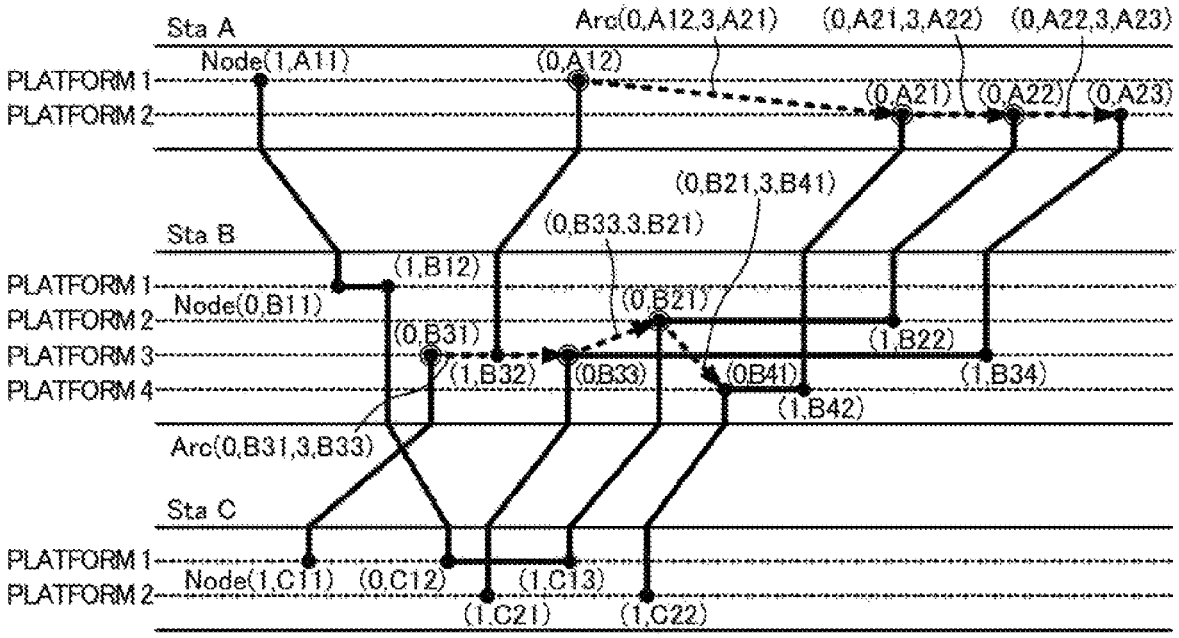
FIG. 12 illustrates creation of a first arrival/departure sequence arc.

Subsequently, the arrival-departure sequence arc will be described. According to this embodiment the arrival/departure sequence arc is classified into four types. FIG. 12 illustrates creation of a first arrival/departure sequence arc. The first arrival/departure sequence arc (arrival in the same travel direction) is an arc connected from an arrival timing node of a certain train to the next arrival timing node of another train when the nodes are sorted in ascending order for each travel direction at a certain station. The first arrival/departure sequence arc is created on the basis of train information by searching the node information sorted for each station and each travel 10 direction in order from the earlier arrival timing, setting the arrival timing as a reference node, and setting the next arrival timing of another train as a link destination node. In FIG. 12, the dashed-line arrow indicates the first arrival-departure sequence arc. In addition, the first arrival/departure sequence arc is expressed in the form of "Arc (0, reference node ID (arrival), 3, link destination node ID (arrival))." For example, the first arrival/departure sequence arc that links the arrival node A12 of Platform 1 of Station A and the arrival node A21 of Platform 2 of Station A is expressed as "Arc (0, A12, 3, A21)."

Note that each value of the weight of the first arrival/departure sequence arc is set as follows.

Minimum headway: set a headway hour/minute (minimum value) predefined for a station and a travel direction similar to a combination of two nodes set on foe existing timetable data.

Maximum headway: set to the maximum operable time (for example, twenty four hours).

The selected headway hour/minute is determined as follows depending on a combination of classifications relating to arrival/departure and stopping/passing of the link origin (reference) node and the link destination node.

TABLE 6-1A

| Link Origin (Reference) Node | Link Destination Node | Selected Headway Hour/Minute |
|---|---|---|
| Stopping Train Arrival | Stopping Train Arrival | Relevant Station and Direction distinction AA Headway |
| Stopping Train Arrival | Passing Train Arrival | Relevant Station and Direction distinction AP Headway |
| Passing Train Arrival | Stopping Train Arrival | Relevant Station and Direction distinction PA Headway |
| Passing Train Arrival | Passing Train Arrival | Relevant Station and Direction distinction PP Headway |

When the passing train sequence holding mode is selected (held) on the diagram correction mode setting screen of FIG. 6, a creation condition of the first arrival/departure sequence arc is different depending on stopping or passing of the link destination node. When the passing train sequence holding mode is deselected (not held), the arc creation condition is different depending on a combination of stopping/passing of the link origin node and stopping/passing of the link destination node. Specifically, the creation condition of the first arrival/departure sequence arc is determined as follows.

TABLE 6-1B

| Passing Train Sequence holding | Link Origin (Reference) Node | Link Destination Node: Stop | Link Destination Node: Pass |
|---|---|---|---|
| Hold | * | Creating the arc from the node of the arriving train to the node of the next arriving train in the same running direction. | Creating the arc from the node of the arriving train to the node of the next arriving train in the same running direction. |
| Not hold | Stop | Creating the arc from the node of the arriving train to the node of the next arriving train in the same running direction. | Not creating the arc |
| | Pass | Not creating the arc | Not creating the arc |

Figure 13:
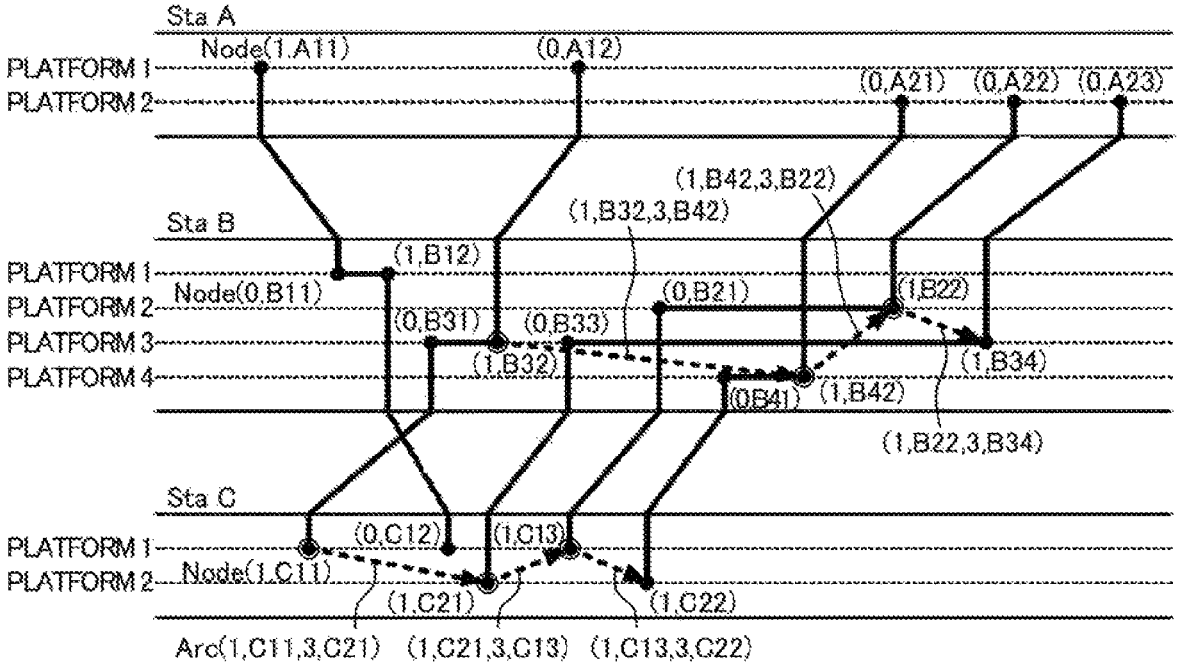
FIG. 13 illustrates creation of a second arrival/departure sequence arc.

FIG. 13 illustrates creation of a second arrival/departure sequence arc. The second arrival/departure sequence arc (departure in the same travel direction) is an arc connected from a departure timing node of a certain train to the next departure timing node of another train when the nodes are sorted in ascending order for each travel direction at a certain station. The second arrival/departure sequence arc is created on the basis of train information by searching the node information sorted for each station and each travel direction in order from the earlier departure timing, setting the departure timing as a reference node, and setting the next departure timing of another train as a link destination node. In FIG. 13, the dashed-line arrow indicates the second arrival/departure sequence arc. In addition, the second arrival/departure sequence arc is expressed in the form of "Arc (1, reference node ID (departure), 3, link destination node ID (departure))." For example, the second arrival/departure sequence arc that links the departure node B32 of Platform 3 of Station B and the departure node B42 of Platform 4 of Station B is expressed as "Arc (1, B32, 5, B42)."

Note that each value of the weight of the second arrival/departure sequence arc is set as follows.

Minimum headway: set a headway hour/minute (minimum value) of the same route predefined for a station and a travel direction similar to a combination of two nodes set on the existing timetable data.

Maximum headway: set to the maximum operable time fibs example. twenty four hours).

The selected headway hour/minute is determined as follows depending on a combination of classifications relating to arrival/departure and stopping/passing of the link origin (reference) node and the link destination node.

TABLE 6-2A

| Link Origin (Reference) Node | Link Destination Node | Selected Headway Hour/Minute |
|---|---|---|
| Stopping Train Departure | Stopping Train Departure | Relevant Station and Direction distinction DD Headway |
| Stopping Train | Passing Train | Relevant Station and |

TABLE 6-2A-continued

| Link Origin (Reference) Node | Link Destination Node | Selected Headway Hour/Minute |
|---|---|---|
| Departure | Departure | Direction distinction DP Headway |
| Passing Train Departure | Stopping Train Departure | Relevant Station and Direction distinction PD Headway |
| Passing Train Departure | Passing Train Departure | Relevant Station and Direction distinction PP Headway |

When the passing train sequence holding mode is selected (held) on the diagram correction mode selling screen of FIG.

6, a creation condition of the second arrival/departure sequence arc is different depending on slopping or passing of the link destination node. When the passing train sequence holding mode is deselected (not held), the arc creation condition is different depending on a combination of stopping/passing of the link origin node and stopping/passing of the link destination node. Specifically, the creation condition of the second arrival/departure sequence arc is determined as follows.

TABLE 6-2B

| Passing Train Sequence holding | Link Origin (Reference) Node | Link Destination Node: Stop | Link Destination Node: Pass |
|---|---|---|---|
| Hold | * | Creating the arc from the node of the departing train to the node of the next departing train in the same running direction. | Creating the arc from the node of the departing train to the node of the next departing train in the same running direction. |
| Not Hold | Stop | Creating the arc from the node of the departing train to the node of the next departing train in the same running direction. | Not creating the arc |
| | Pass | Not creating the arc | Not creating the arc |

Figure 14:
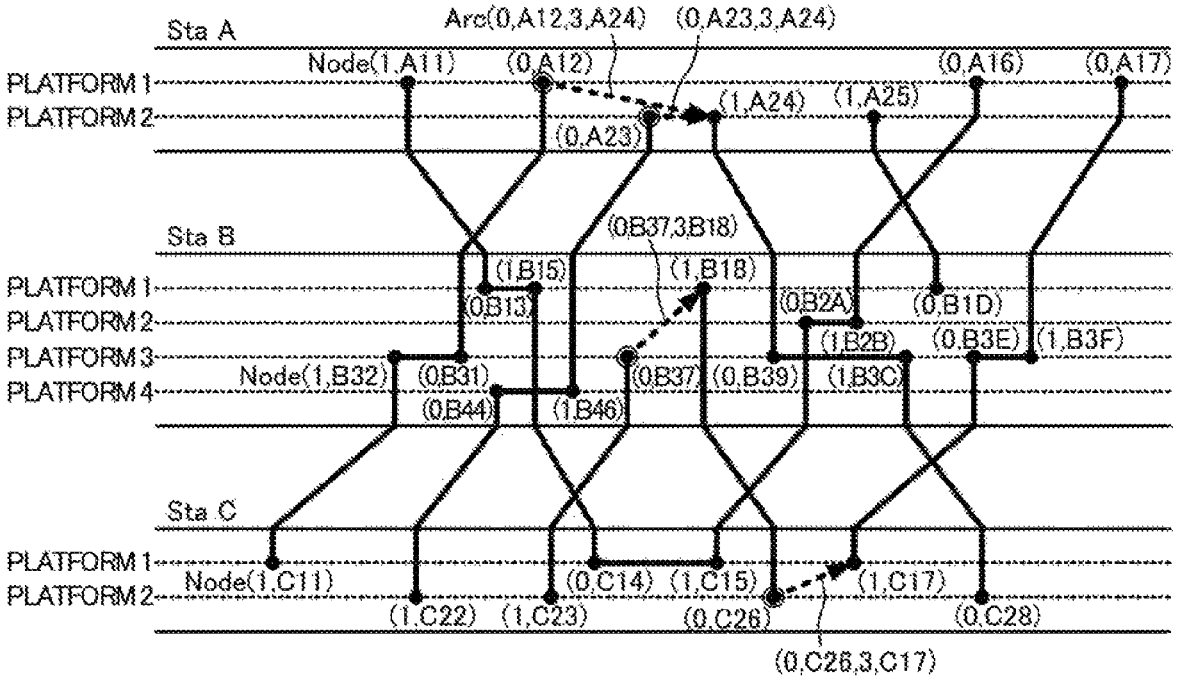
FIG. 14 illustrates creation of a third arrival/departure sequence arc.

FIG. 14 illustrates creation of a third arrival/departure sequence arc. The third arrival/departure sequence (turnaround arrival/departure) arc is an arc connected front a last-run arrival timing node of a certain train included in a single vehicle operation schedule (train operation schedule) to a first-run departure timing node in the opposite direction at the same station included in another vehicle operation schedule. The third arrival/departure sequence arc is created on the basis of the train information and the vehicle operation schedule information by setting the last-run arrival timing as a reference node and setting the next departure timing of another train of the opposite direction as a link destination node. In FIG. 14, the dashed-line arrow indicates the third arrival/departure sequence arc. In addition, the third arrival-departure sequence arc is expressed in the form of "Arc (0, reference node ID (arrival), 3, link destination node ID (departure in the opposite direction))." For example, the third arrival depart we sequence arc that links the arrival node A12 of Platform 1 of Station A and the departure node A24 of Platform 2 of Station A in the opposite direction is expressed as "Arc (0, A12, 3, A24)."

Note that each value of the weight of the third arrival/departure sequence arc is set as follows.

Minimum headway; set a turnaround arrival departure headway hour/minute (minimum value) predefined for a station and a turnaround direction similar to a combination of two nodes set on the existing timetable data.

Maximum headway: set to the maximum operable time (for example, twenty four hours).

The selected headway hour/minute is determined as follows depending on a combination of classifications relating to arrival/departure and stopping/passing of the link origin (reference) node and the link destination node.

TABLE 6-3A

| Link Origin (Reference) Node | Link Destination Node | Selected Headway Hour/Minute |
|---|---|---|
| Stopping Train Arrival | Stopping Train Departure | Relevant Station and Turn Around Direction AD Headway |
| Stopping Train Arrival | Passing Train Departure | Relevant Station and Turn Around Direction AP Headway |

When the turnaround train sequence holding mode is selected (held) on the diagram correction mode setting screen of FIG. 6, a creation condition of the third arrival/departure sequence arc is different depending on a combination of travel directions of two trains and availability of the platform in the station. When the turnaround train sequence holding mode is deselected (not held), the arc may not be created. Specifically, the creation condition for the third arrival/departure sequence arc is determined as follows.

TABLE 6-3B

| Turnaround Train Sequence Holding | Travel Directions of Two Trains | Station with a Platform | Station without a Platform |
|---|---|---|---|
| Hold | Equivalence direction | Creating the arc from the node of the train arriving to the terminus station to the node of the next train arriving to the terminus station. | Creating the arc from the node of the train arriving to the terminus station to the node of the next train arriving to the terminus station in the same running direction. |
| | Opposite direction | Creating the arc from the node of the train arriving to the terminus station to the node of the next train arriving to the terminus station. | Not creating the arc |
| Not Hold | * | Not creating the arc | Not creating the arc |

Figure 15:
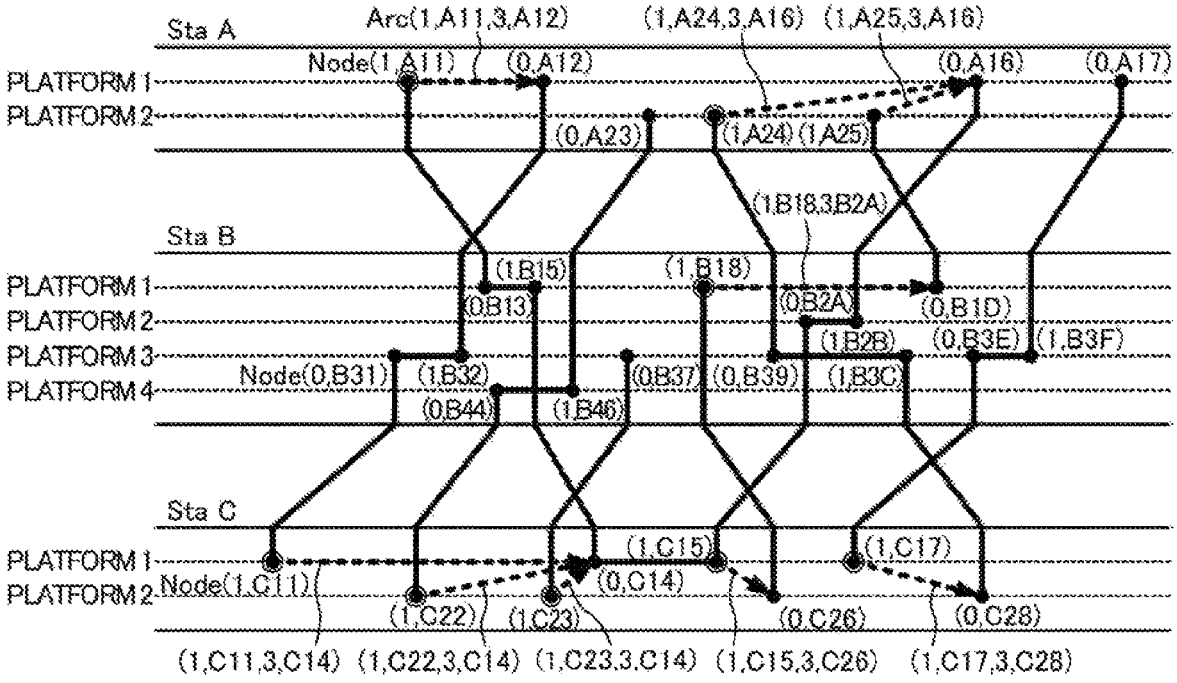
FIG. 15 illustrates creation of a fourth arrival/departure sequence arc.

FIG. 15 illustrates creation of a fourth arrival/departure sequence arc. The fourth, arrival/departure sequence (turnaround arrival departure) arc is an arc connected from a first-run departure timing node of a certain train included in a single vehicle operation schedule to a last-ran arrival timing node arriving in the opposite direction at the same station included in another vehicle operation schedule. The fourth arrival/departure sequence arc is created on the basis of the train information and the vehicle operation schedule information by setting the first-run departure timing as a reference node and setting the next arrival timing of another train of the opposite direction as a link destination node. In FIG. 15, the dashed-line arrow indicates the fourth arrival/departure sequence arc. In addition, the fourth arrival/departure sequence arc is expressed in the form of "Arc (1, reference node ID (departure), 3, link destination node ID (arrival is the opposite direction)))." For example, the fourth arrival/departure sequence arc that links the departure node A11 of Platform 1 of Station A and the arrival node A12 of Platform 1 of Station A in the opposite direction is expressed as "Arc (1, A11, 3, A 12)."

TABLE 6-4A

| Link Origin (Reference) Node | Link Destination Node | Selected Headway Hour/Minute |
|---|---|---|
| Stopping Train Departure | Stopping Train Arrival | Relevant Station and Turn Around Direction DA Headway |
| Stopping Train Departure | Passing Train Arrival | Relevant Station and Turn Around Direction DP Headway |

When she turnaround train sequence holding mode is selected (held) on the diagram correction mode setting screen of FIG. 6, a creation condition of the fourth arrival departure sequence arc is different depending on a combination of travel directions of two trains and availability of the platform in the station. When the turnaround train sequence holding mode is deselected (not held), the arc may not be created. Specifically, the creation condition for the fourth arrival/departure sequence arc is determined as follows.

TABLE 6-4B

| Turnaround Train Sequence Holding | Travel Directions of Two Trains | Station with a Platform | Station without a Platform |
|---|---|---|---|
| Hold | Equivalence direction | Creating the arc from the node of the first train to the node of the next first train. | Creating the arc from the node of the first train to the node of the next first train in the same running direction. |
| | Opposite direction | Creating the arc from the node of the first train to the node of the next first train. | Not creating the arc |
| Not Hold | * | Not creating the arc | Not creating the arc |

Note that each value of the weight of the fourth arrival/departure sequence arc is set as follows.

Minimum headway: set a turnaround arrival/departure headway hour/minute (minimum value) predefined for a station and a turnaround direction similar to a combination of two nodes set on the existing timetable data.

Maximum Headway: set to the maximum operable time (for example, twenty four hours).

The selected headway hour/minute is determined as follows depending on a combination of classifications relating to arrival/departure raid stopping/passing of the link origin (reference) node and the link destination node.

5. Creation of Platform Sequence Arc

Figure 16:
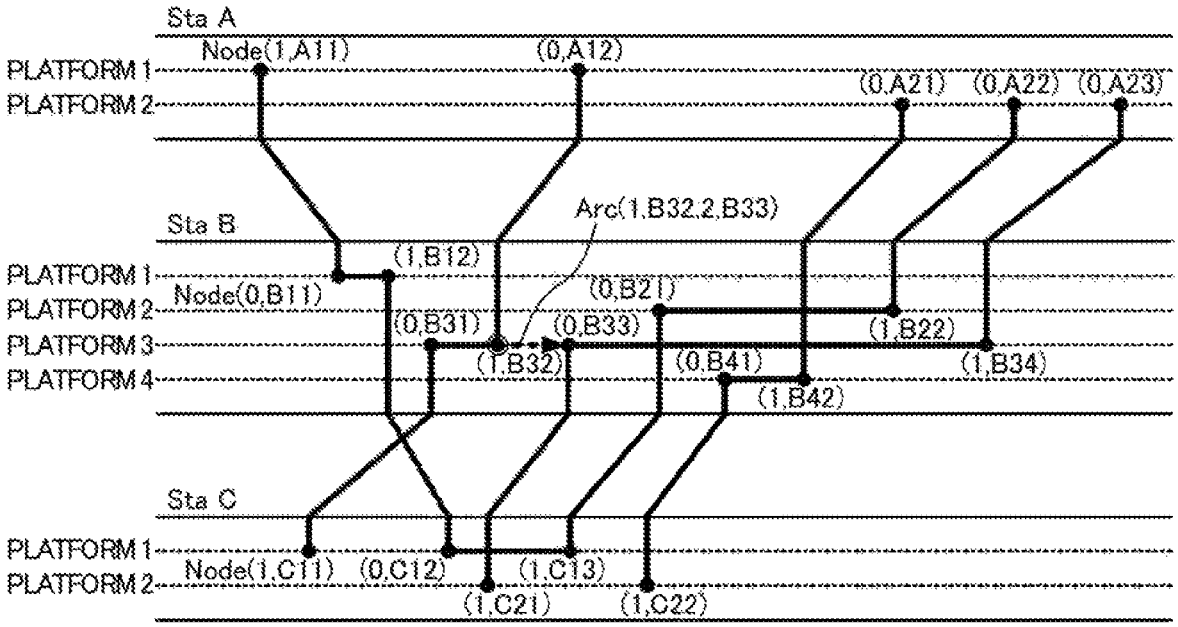
FIG. 16 illustrates creation of a first platform sequence arc.

Subsequently, a platform sequence arc will be described. According to this embodiment, the platform sequence arc is classified into three types. FIG. 16 illustrates creation of a first platform sequence arc. The first platform sequence arc is an arc connected from a departure timing node of a certain train to the next arrival timing node of another train when the nodes are sorted in ascending order for each platform of a certain station. The first platform sequence arc is created on. the basis of the train information by searching the node information sorted for each station and each platform in order from the earlier departure timing, setting the departure timing as a reference node, and setting the next arrival tinting of another train as a link destination node. In FIG. 16, the dashed-line arrow indicates the first platform sequence arc. In addition, the first platform sequence arc is expressed in the form of "Arc (0, reference node ID (departure), 2, link destination node ID (arrival)." for example, the first platform sequence arc that links the departure node B32 of Platform 3 of Station B and the arrival node B33 of Platform 3 of Station B is expressed as "Arc (1, B32, 2, B33)."

Note that each value of the weight of the first platform sequence arc is set as follows.

Minimum headway: set a headway hour/minute (minimum value) predefined for a station and a platform similar to a combination of two nodes set on the existing timetable data.

Maximum headway: set to the maximum operable time (for example, twenty four hours).

The selected headway hour/minute is determined as follows depending on a combination of classifications relating to arrival-departure and stopping/passing of the link origin (reference) node and the link destination node.

TABLE 6-5A

| Link Origin (Reference) Node | Link Destination Node | Selected Headway Hour/Minute |
|---|---|---|
| Stopping Train Departure | Stopping Train Arrival | Relevant Station and Platform DA Headway |
| Stopping Train Departure | Passing Train Arrival | Relevant Station and Platform DP Headway |
| Passing Train | Stopping Train | Relevant Station and |

TABLE 6-5A-continued

| Link Origin (Reference) Node | Link Destination Node | Selected Headway Hour/Minute |
|---|---|---|
| Departure | Arrival | Platform PA Headway |
| Passing Train | Passing Train | Relevant Station and |
| Departure | Arrival | Platform PP Headway |

When the passing train sequence holding mode is selected (held) on the diagram correction mode setting screen of FIG. 6, a creation condition of the first platform sequence arc is different depending on a combination of the travel directions of two trains and availability of the platform in the station. When the passing train sequence holding mode is deselected (not held), the arc creation condition is different depending on a combination of the travel directions of two trains, classification of stopping/passing of the link origin node and the link destination node, and availability of the platform in the station. Specifically, the creation condition of the first platform sequence arc is determined as follows.

TABLE 6-5B

| Turnaround Train Sequence Holding | Travel Directions of Two Trains | Link Origin Node | Link Destination Node | Station with a Platform | Station without a Platform |
|---|---|---|---|---|---|
| Hold | Equivalence direction | * | * | Creating the arc from the node of the departing train to the node of the train arriving to the platform where the departing train departs. | Creating the arc from the node of the departing train to the node of the train arriving to the platform where the departing train departs in the same running direction |
| | Opposite direction | * | * | Creating the arc from the node of the departing train to the node of the train arriving to the platform where the departing train departs. | Not creating the arc |
| Not Hold | Equivalence direction | Stop | Stop | Creating the arc from the node of the departing train to the node of the train arriving to the platform where the departing train departs. | Creating the arc from the node of the departing train to the node of the train arriving to the platform where the departing train departs in the same running direction |
| | | * Pass | Pass * | Not creating the arc | Not creating the arc |
| | Opposite direction | Stop | Stop | Creating the arc from the node of the departing train to the node of the train arriving to the platform where the departing train departs. | Not creating the arc |
| | | * Pass | Pass * | Not creating the arc | Not creating the arc |

Figure 17:
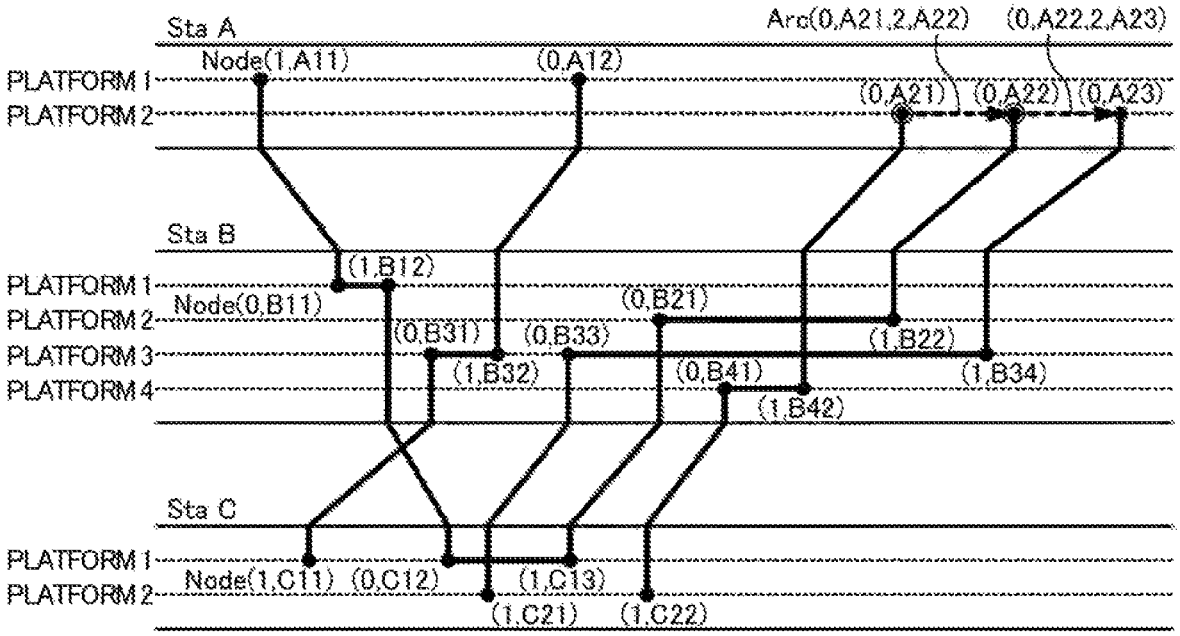
FIG. 17 illustrates creation of a second platform sequence arc.

FIG. 17 illustrates creation of a second platform sequence arc. The second platform sequence arc is an arc connected from a last-run arrival timing node of a certain train to the next node of another train when the nodes are sorted in ascending order for each platform of a certain station. The second platform sequence arc is created on the basis of the train information by searching the node information sorted for each station and each platform in order from the earlier arrival timing, setting the last-run arrival timing as a reference node, and setting the next node of another train as a link destination node. In FIG. 17, the dashed-line arrow indicates the second platform sequence arc. In addition, the second platform sequence arc is expressed in the form of "Arc (0, reference node ID (terminus arrival), 2, link destination node ID)." For example, the second platform sequence arc that links the terminus arrival node A21 of Platform 2 of Station A and the node A22 of Platform 2 of Station A is expressed as "Arc (0, A21, 2, A22)."

Note that each value of the weight of the second platform sequence arc is set as follows.

Minimum headway: set a headway hour/minute (minimum value) predefined for a station and a platform similar to a combination of two nodes set on the existing timetable data.

Maximum headway: set to the maximum operable time (for example, twenty four hours).

The selected headway hour/minute is determined as follows depending on a combination of classifications relating to arrival/departure and stopping/passing of the link origin (reference) node and the link destination node.

TABLE 6-6A

| Link Origin (Reference) Node | Link Destination Node | Selected Headway Hour/Minute |
|---|---|---|
| Stopping Train Arrival | Stopping Train Arrival | Relevant Station and Platform AA Headway |
| Stopping Train Arrival | Passing Train Arrival | Relevant Station and Platform AP Headway |

The creation condition for the second platform sequence arc is different depending on a combination of the travel directions of two trains and availability of the platform in the station. Specifically, the creation condition of the second platform sequence arc is determined as follows.

TABLE 6-6B

| Travel Directions of Two Trains | Station with a Platform | Station without a Platform |
|---|---|---|
| Equivalence direction | Creating the arc from the node of the train arriving to a platform of the terminus station to the node of the next train arriving to the platform of the terminus station. | Creating the arc from the node of the train arriving to the terminus station to the node of the next train arriving to the terminus station in the same running direction. |
| Opposite direction | Creating the arc from the node of the train arriving to a platform of the terminus station to the node of the next train arriving to the platform of the terminus station. | Not creating the arc. |

Figure 18:
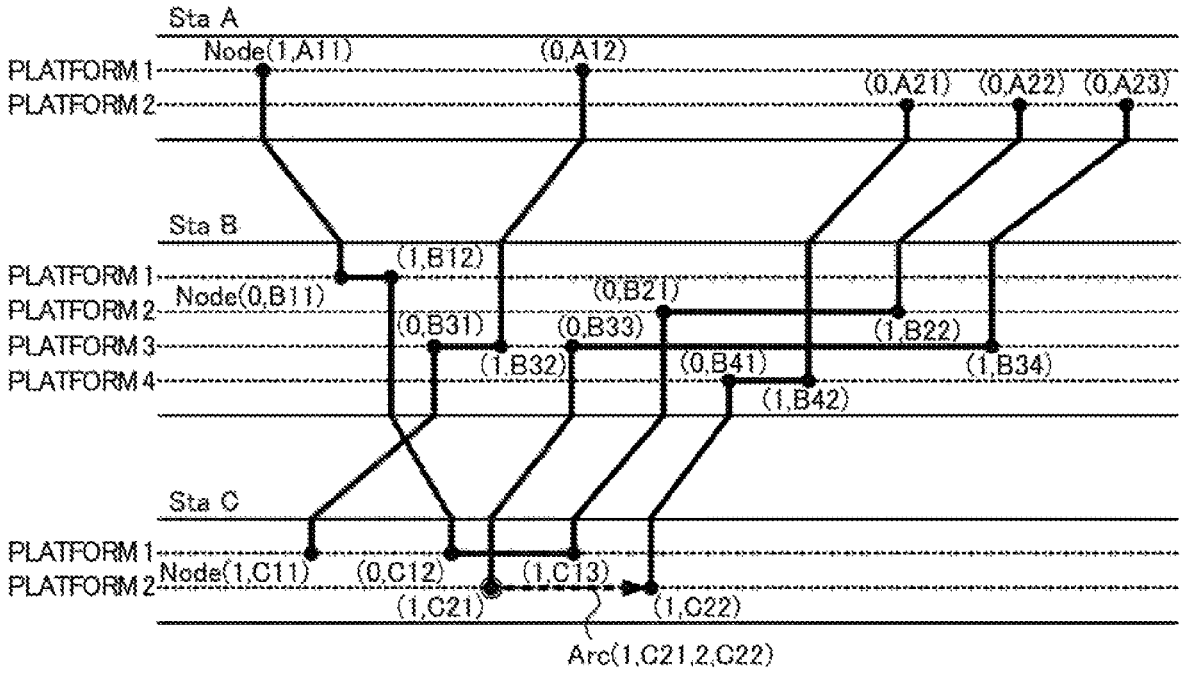
FIG. 18 illustrates creation of a third platform sequence arc.

FIG. 18 illustrates creation of a third platform sequence arc. The third platform sequence arc is an arc connected from a first-run departure timing node of a certain train to the next node of another train when the nodes are sorted in ascending order for each platform of a certain station. The third platform sequence arc is created on the basis of predetermined train information by searching the node information sorted for each station and each platform in order from the earlier departure timing, setting the first-run departure timing as a reference node, and setting the next node of another train as a link destination node. In FIG. 18, the dashed-line arrow indicates the third platform sequence arc. In addition, the third platform sequence arc is expressed in the form of "Arc (1, reference node ID (first-run departure), 2, link destination node ID)." For example, the third platform sequence arc that links the first-run departure node C21 of Platform 2 of Station C and the node C22 of Platform 2 of Station C is expressed as "Arc (1, C21, 2, C22)."

Note that each value of the weight of the third platform sequence arc is set as follows.

Minimum headway (seconds): set a headway hour/minute (minimum value) predefined for a station and a platform similar to a combination of two nodes set on the existing timetable data.

Maximum headway (seconds): set to the maximum operable lime (for example, twenty four hours).

The selected headway hour/minute is determined as follows depending on a combination of classifications relating to arrival/departure and stopping/passing of the link origin (reference) node and the link destination node.

TABLE 6-7A

| Link Origin (Reference) Node | Link Destination Node | Selected Headway Hour/Minute |
|---|---|---|
| Stopping Train Departure | Stopping Train Departure | Relevant Station and Platform DD Headway |
| Stopping Train Departure | Passing Train Departure | Relevant Station and Platform DP Headway |

The creation condition for the third platform sequence arc is different depending on a combination of the travel directions of two trains and availability of the platform in the station. Specifically, the creation condition of the third platform sequence arc is determined as follows.

TABLE 6-7B

| Travel Directions of Two Trains | Station with a Platform | Station without a Platform |
|---|---|---|
| Equivalence direction | Creating the arc from the node of the first train to the node of the next first train departing from the platform where the first train departs. | Creating the arc from the node of the first train to the node of the next first train departing from the platform where the first train departs in the same running direction. |
| Opposite direction | Creating the arc from the node of the first train to the node of the next first train departing from the platform where the first train departs. | Not creating the arc. |

<Network Diagram Update Process>

Figure 19:
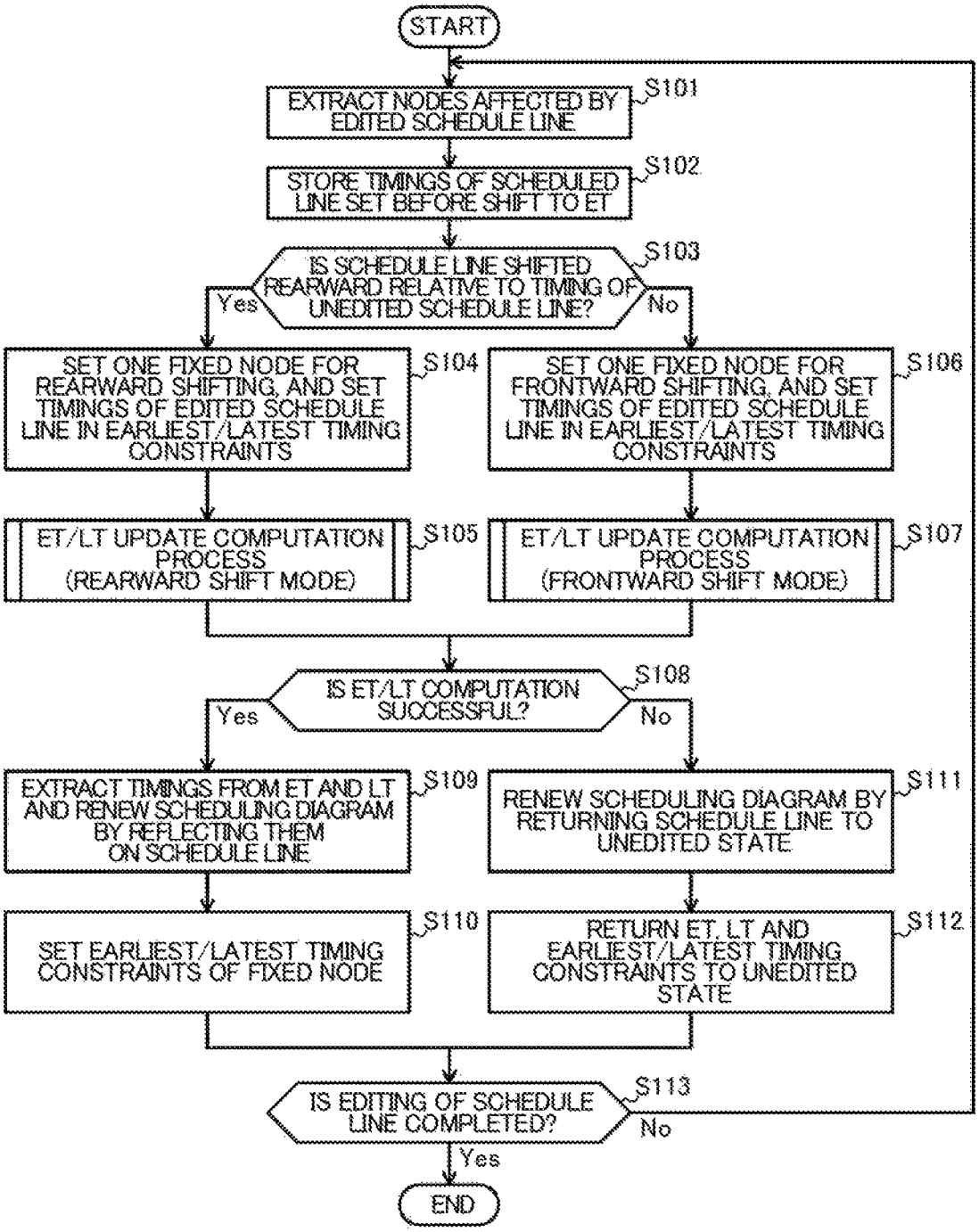
FIG. 19 is a flowchart illustrating a specific example of a network diagram update process using a network diagram update unit of FIG. 1.

FIG. 19 is a flowchart illustrating a specific example of a network diagram update process using the network diagram update unit 14*b* of FIG. 1. This process is started when a user edits the scheduling diagram on a screen.

First, the network diagram update unit 14*b* extracts all of the nodes influenced by the edited schedule line (step S101) and stores timings of each node set before shifting of the schedule line as initial values of the earliest timings (ET) for each node.

Then, the network diagram update unit 14*b* determines whether or not the edited schedule line is shifted rearward (delayed) on the time-series sequence relative to the previous scheduled timing (step S103). If it is determined that the edited schedule line is shifted rearward (YES in step S103), a single fixed node is selected on the basis of a rearward shift rule, and a timing of the edited schedule line is set as an earliest/latest timing constraint (step S104). In addition, ET/LT update computation is performed in a rearward shift mode (step S105).

For example, in the case of the latest timing LT, on the basis of the latest timing constraint LTmax to be fulfilled by each node, the initial value LT0 is updated (decremented) depending on a repetition number as follows, so that the constraint becomes gradually stricter to detect a node most possibly acting as a bottle neck. Here, "DT1" and "DT2" denote corrected values, and the repetition number refers to the number of repeating step S102.

$$LT0=LT\max+(DT1-\text{repetition number}\times DT2)$$

Since the latest timing constraint LTmax as a maximum time interval constraint is included, this update computation is different from the PERT-based timing update computation known in the art.

The ET/LT update computation using the network diagram update unit 14*b* will be described in brief In order to process both the minimum and maximum time interval constraints, it is necessary to repeatedly perform time update computation for each of ET and LT on the following sequence until there is no change in the value. Reference signs and symbols used in the description are defined as follows.

T(i,j): minimum time interval between nodes "i" and "j" (minimum weight of arc)

h: node shifted (preceding) to node "i"

ETmin(i): constraint of earliest timing available for node "i"

k: node shifted (following) to node "i"

LTmax(i): constraint of latest timing available for node "i"

The update is performed in order of the following sequences 1 to 4.

[Sequence 1: Topological Sorting of Nodes]

In the case of the earliest timing ET, it is necessary to compute the value in order from the preceding node (in the case of LT, in the opposite order), topological sorting is performed in advance. According to the topological sorting, if a node "A" precedes a node "B," overall nodes are rearranged in order such that the node "A" necessarily precedes the node "B."

[Sequence 2: Initialization]

For all of the nodes "i," initialization is performed as follows. Note that, as described above, in the coarse of detecting a constraint violation node, the initial value is corrected by the earliest latest timing constraint change unit 14*d*.

ET0(i)=ETmin(i)

LT0(i)=LTmax(i)

[Sequence 3: ET Update Computation]

The computation of the following formulas (1) and (2) is repeated alternatingly until the resulting value is converged fixedly.

Here, "ETs-1" denotes the value not subjected to the updating, and "ETs" denotes the updated value.

[Equation 1]

$$ETs(i) = \max_h [ET(h) + T_{min}(h, i), ET_{s-1}(i)] \quad (1)$$

$$ETs(i) = \max_k [ET(k) + T_{min}(i, k), ET_{s-1}(i)] \quad (2)$$

"H" represents a node to be connected to the front of the node i.

"K" represents a node to be connected to the rear of the node i.

[Sequence 4: LT Update Computation]

The computation of the following formulas (3) and (4) is repeated alternatingly until the resulting value is converged fixedly.

Here, "LTs-1" denotes the value not subjected to the updating, and "LTs" denotes the updated value.

[Equation 2]

$$LTs(i) = \max_h [LT(h) + T_{max}(h, i), LT_{s-1}(i)] \quad (3)$$

$$LTs(i) = \min_k [LT(k) + T_{min}(i, k), LT_{s-1}(i)] \quad (4)$$

"H" represents a node to be connected to the front of the node i.

"K" represents a node to be connected to the rear of the node i.

Note that the values of "ET" and "LT" may be computed independently, and the ET update computation and the LT update computation may also be performed in the opposite order. In addition, the computation of the formulas (1) to (4) may be performed using the same repeated computation loop.

In step S103 of FIG. 19, if the network diagram update unit 14*b* detonate that the node is shifted frontward (expedited) from the previous schedule timing (NO in step S103), a single fixed node is selected on the basis of a frontward shift rule, and the timing of the edited schedule line is set as the earliest/latest timing constraint (step S106). in addition, the ET/LT update computation is performed in the frontward shift mode (S107). Steps S107 and S105 are different in that the processing procedure is partially reversed. This will be described below in more detail in relation to FIGS. 20A and 20B.

Then, the network diagram update unit 14*b* determines whether or not the ET/LT update computation in step S105 or S107 is successful (step S108). Here, if it is determined that the computation is successful (YES in step S108), the timings determined through the computation are extracted from the value "ET" or "LT," and are applied to the schedule line to renew the network diagram (step S109). In addition, the earliest latest tuning constraint for the fixed node is set (step S110), and the process advances to step S113. Otherwise, if it is determined that the computation is not successful, that is, if a violation node occurs (NO in step S108), the renewal is performed by returning the schedule line to the previous state (step S111). In addition, the earliest timing ET, the latest timing LT, and the latest timing constraint are returned to the previous values (step S112). Then, the process advances to step S113.

In step S113, the network diagram update unit 14*b* determines whether or not a user completes the schedule line editing. Specifically, it is determined whether or not a user instructs to close the editing screen. Here, if it is determined that the schedule line editing is completed (YES in step S113), the process is terminated. Otherwise, if it is determined that the schedule line editing is not completed (NO in step S113), the process returns to step S101.

Figure 20A:
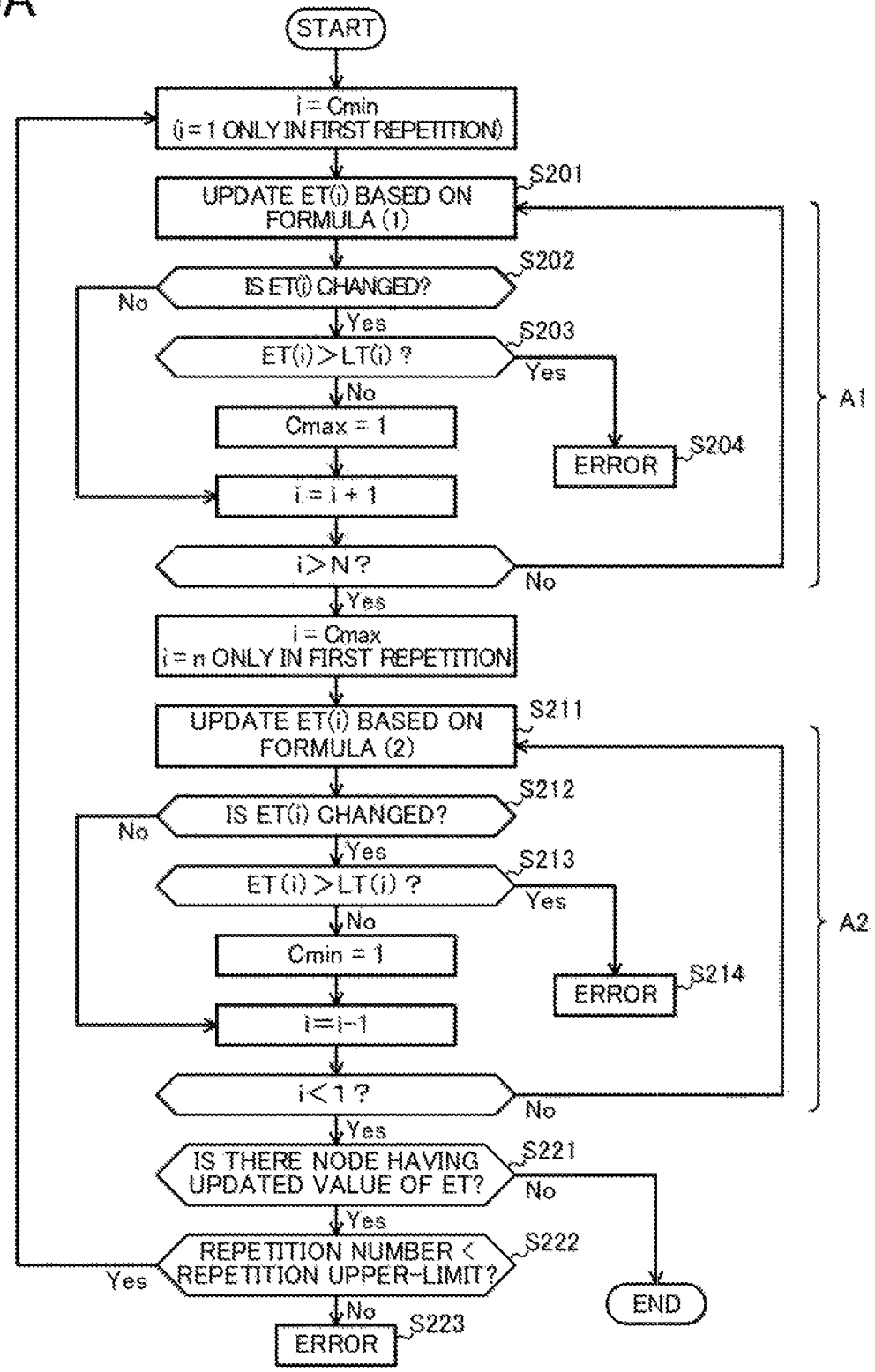
FIG. 20A is a flowchart illustrating a specific processing example of step S105 of FIG. 19.

FIG. 20A is a flowchart illustrating a specific processing example of step S105 of FIG. 19.

In block A1, for each node, update computation for "ET(i)" is performed on the basis of formula (1) (step S201). If there is a node having a value of "ET(i)" greater than that of "LT(i)" if (YES in steps S202 and S203), an error returns (step S204), and the violation node detection unit 14*c* detects this node as a violation node.

In block A2, for each node, update computation for "ET(i)" is performed on the basis of formula (2) (step S211). If there is a node having a value of "ET(i)" greater than that of "LT(i)" (YES in steps S212 and S213), an error returns (step S214), and the violation node detection unit 14*c* detects this node as a violation node.

If there is no node having an updated value of "ET" (NO in step S221), it is determined that the update computation is converged, and the process is terminated. Otherwise, if there is a node having an updated value of "ET" (YES in step S221). it is determined whether or not the repetition number reaches an upper limitation (step S222). If the repetition number does not reach the upper limitation, blocks A1 and A2 are repeated. If the repetition number reaches the upper limitation (NO in step S222), it is determined that the update computation is not converged, and an error returns (step S223).

A factor "Cmax" described in the flowchart is employed to store the most downstream node among the nodes updated on the basis of formula (1) and limit a confutation, range of formula (2) to those located in the upstream from the most downstream node, in contrast, a factor "Cmin" is employed to store the most upstream node among the nodes updated on the basis of formula (2) and limit a computation range of formula (1) to those located in the downstream from the most upstream node.

Similar to the flowchart of FIG. 20A, for the LT update computation, the procedure for alternatingly updating the values on the basis of formulas (3) and (4) is repeated until the values are converged. This will not be described in detail herein.

Figure 20B:
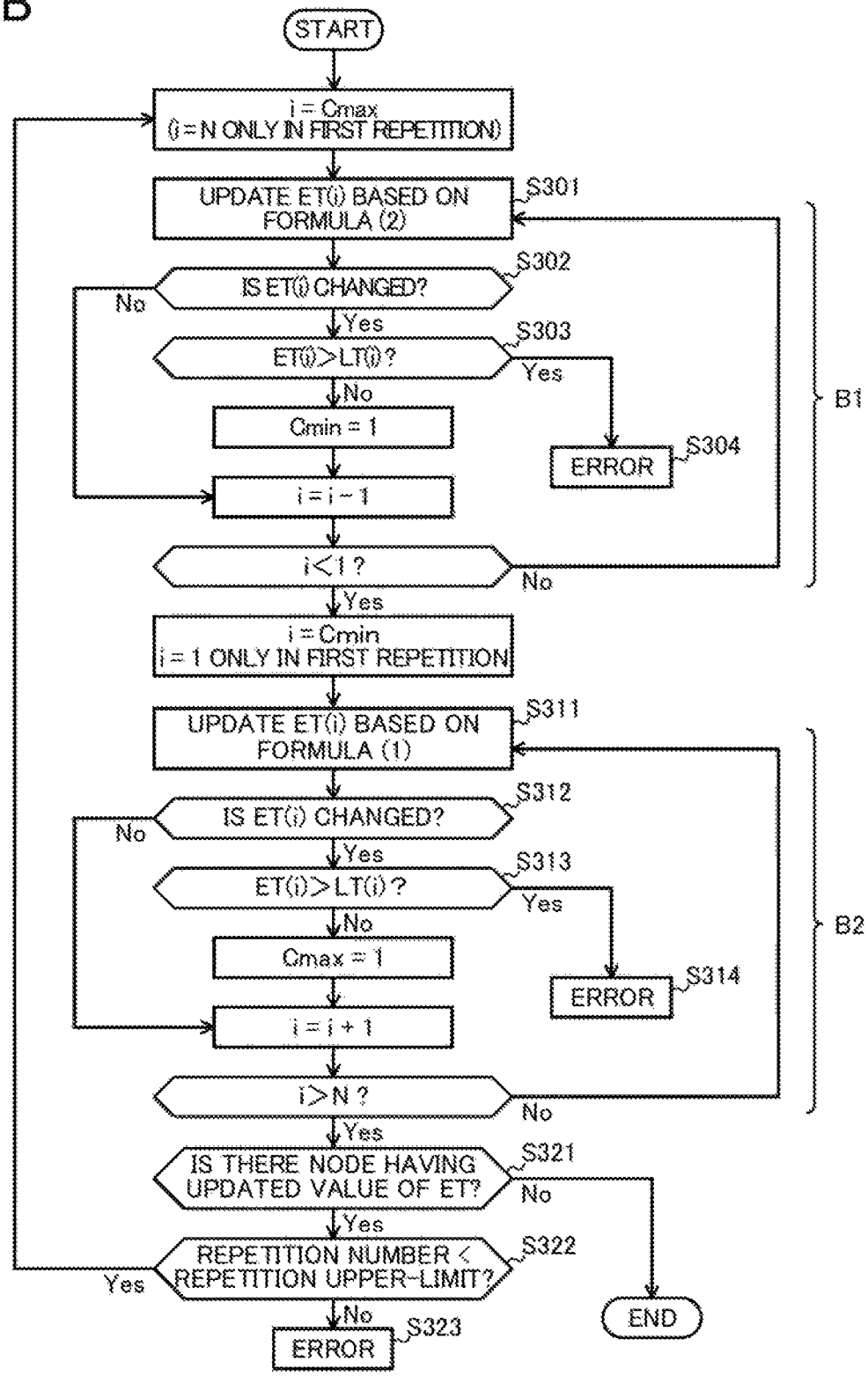
FIG. 20B is a flowchart, illustrating a specific processing example of step S107 of FIG. 19.

FIG. 20B is a flowchart illustrating a specific processing example of step S107 of FIG. 19.

In block B1, update computation of "ET(i)" is performed for each node on the basis of formula (2) (step S301). If there is a node having a value of "ET(i)" greater than that of "LT(i)" (YES in steps S302 and S303), an error returns (step S304), and the violation node detection unit 14*c* detects this node as a violation node.

In block B2, update computation of "ET(i)" is performed for each node on the basis of formula (1) (step S311). If there is a node having a value of "ET(i)" greater than that of "LT(i)" (YES in steps S312 and S313), an error returns (step S314), and the violation node detection unit 14*c* detects this node as a violation node.

There is no node having an updated value of "ET" (NO in step S321), it is determined that the update computation is converged, and the process is terminated. Otherwise, if there is a node having an updated value of "ET" (YES in step S321), it is determined whether or not the repetition number reaches an upper limitation (step S322). If the repetition number does not reach the upper limitation, blocks B1 and B2 are repeated. If the repetition number reaches the upper limitation (NO in step S322), it is determined that the update computation is not converged, and an error returns (step S323).

In this manner, the process of block B1 is similar to that of block A2 of FIG. 20A, and the process of block B2 is similar to that of block A1 of FIG. 20A, but their execution procedures are reversed. Similar to FIG. 20A, the factor "Cmax" described in the flowchart is employed to store the most downstream node among the nodes updated on the basis of formula (1) and limit the computation range of formula (2) to those located in the upstream from the most downstream node. In contrast, the factor "Cmin" is employed to store the most upstream node among the nodes updated on the basis of formula (2) and limit a computation range of formula (1) to those located in the downstream from the most upstream node. Similar to the flowchart of FIG. 20B, for the LT update computation, the procedure for alternatingly updating the values on the basis of formulas (3) and (4) is repeated until the values are converged. This will not be described in detail herein.

<Scheduling Diagram Editing Examples>

At last, several examples in which the schedule line is shifted as a result of the aforementioned process will be described.

Figure 21:
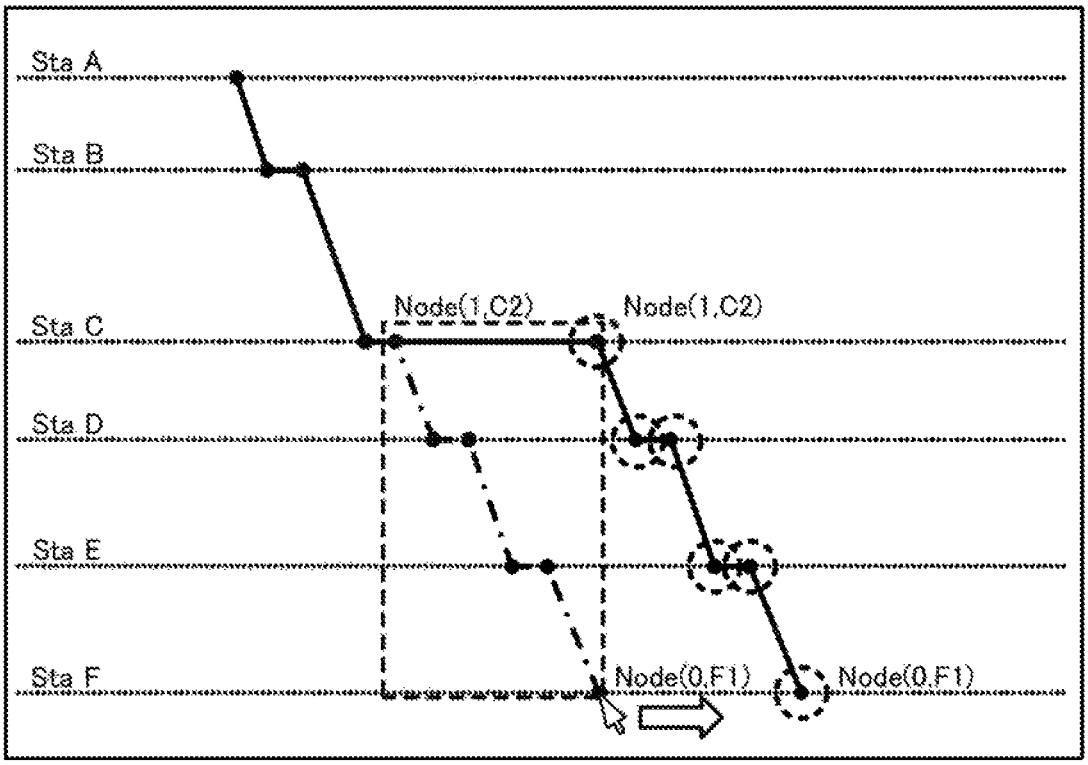
FIG. 21 illustrates a scheduling diagram editing example (1).

FIG. 21 illustrates a scheduling diagram editing example (1). Here, a predetermined range of the schedule line is shifted rightward (delayed) on the screen. In this manner, when a user selects a range from the departure node C2 to the arrival node F1 using a mouse cursor and drags it to the right as a whole, the timings of the nodes indicated by the dotted circles are updated. However, each time interval and each sequence are maintained for the nodes C2 to F1.

Figure 22:
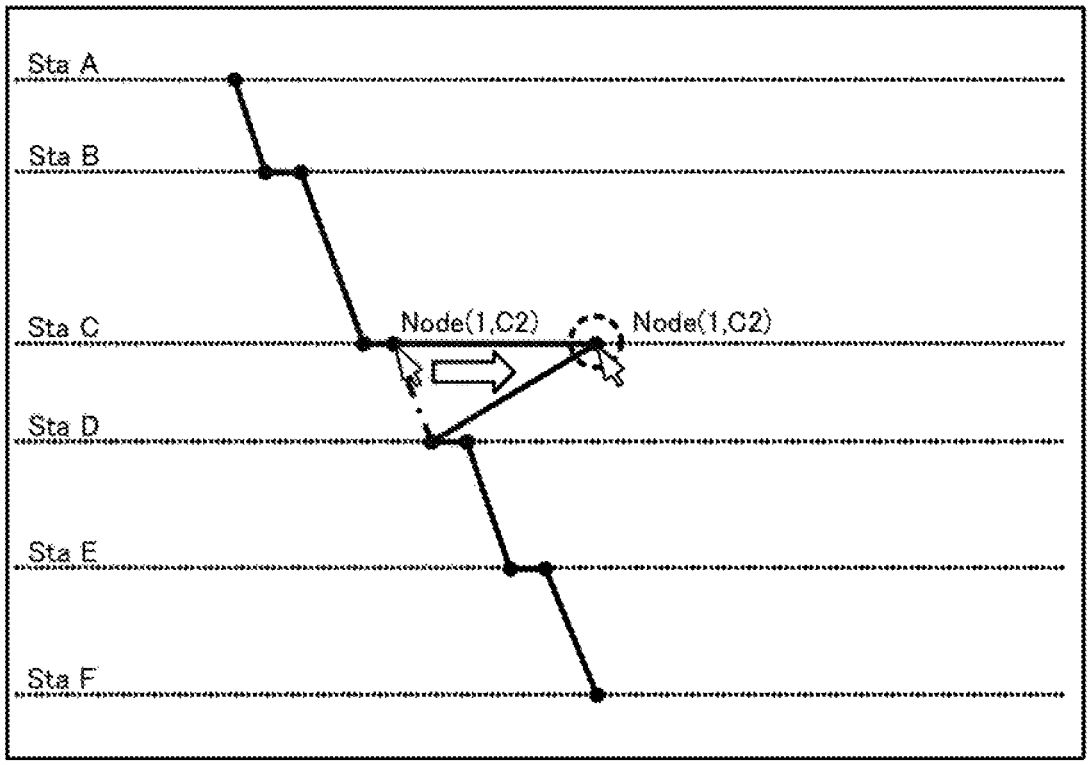
FIG. 22 illustrates a scheduling diagram editing example (2).

FIG. 22 illustrates a scheduling diagram editing example (2). Here, only an arrival node C2 on the schedule line is selected and shifted to the right (delayed) on the screen. In this manner, if only a single node C2 is shifted, the timing of the node C2 is updated. The nodes subsequent to the node C2 are shifted in a chain reaction manner as illustrated in FIG. 21. Alternatively an additional option such as notification of a violation node may be possible.

Figure 23:
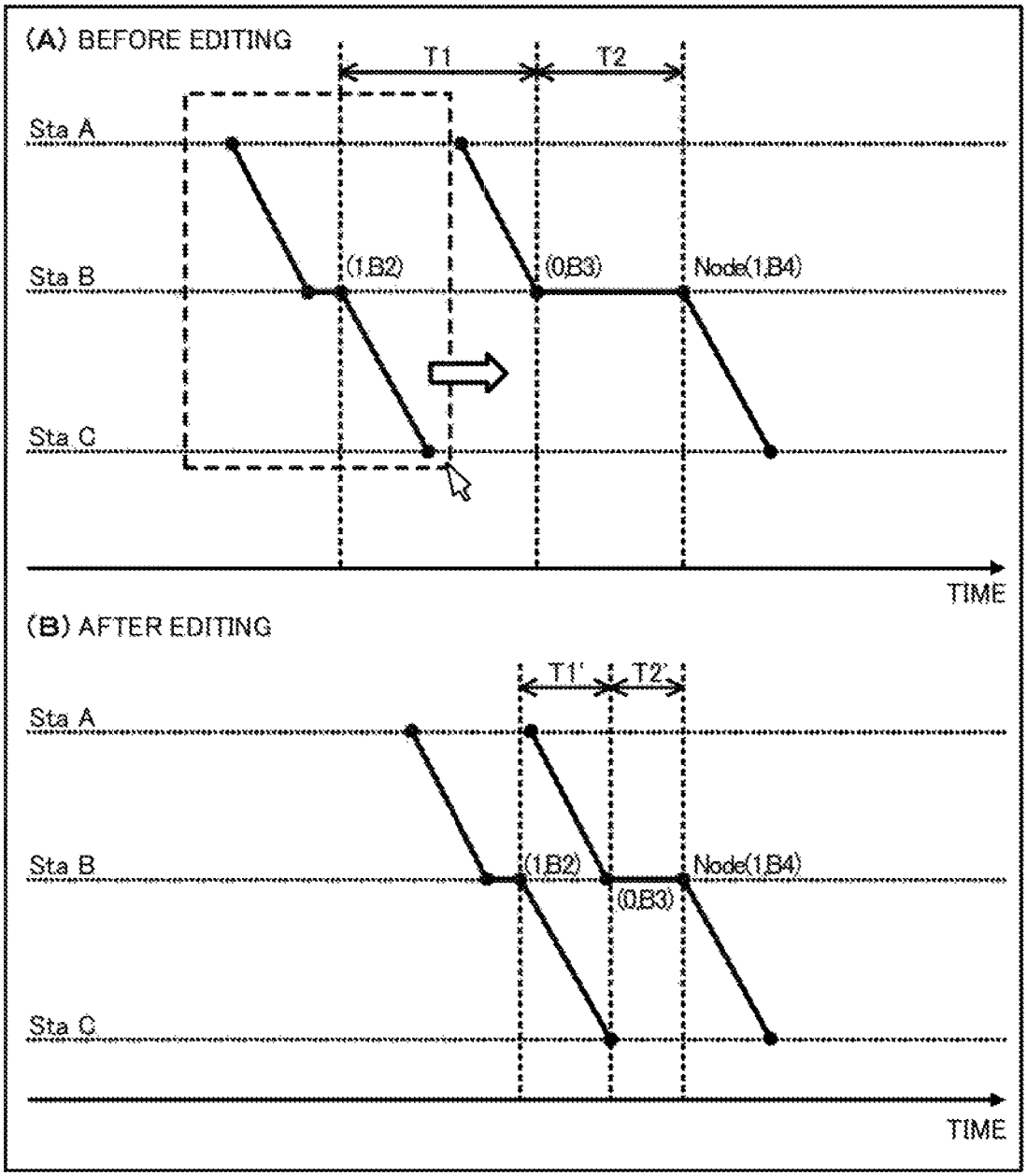
FIG. 23 illustrates a scheduling diagram editing example (3).

FIG. 23 illustrates a scheduling diagram editing example (3). Here, FIG. 23 shows shifting of the schedule when both the reference operation hour/minute application mode and the dwell how/minute reduction allowance mode are selected (applied). Before the editing (in FIG. 23A), a time interval between the departure node B2 and the arrival node B3 is set to "T1" and a time interval between the arrival node B3 and the departure node B4 is set to "T2." In addition, a pair of schedule lines is set to follow the reference operation hour/minute. If the left schedule line is shifted from this lit state to approach the right schedule line having a sufficient dwell time, the scheduling diagram is corrected such that the dwell time is reduced from T2 to T2' while the headway hour/minute T1 of the critical path portion is reduced to its minimum value T1'.

Figure 24:
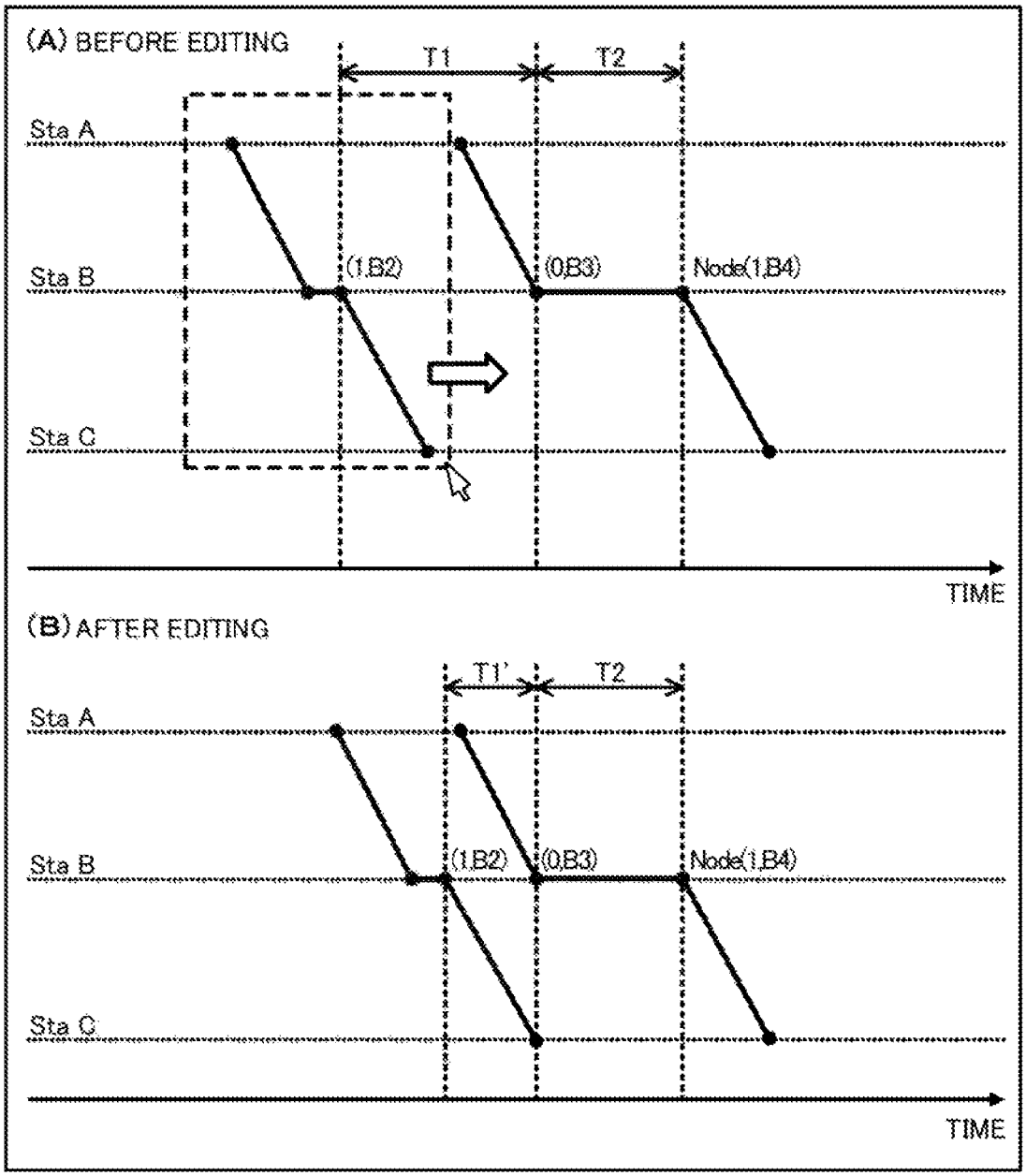
FIG. 24 illustrates a scheduling diagram editing example (4).

FIG. 24 illustrates a scheduling diagram editing example (4). Here, FIG. 24 shows shifting of the schedule line when the reference operation hour/minute application mode is selected, and the dwell hour minute reduction allowance mode is deselected (not applied). Out of a pair of schedule hues based on the reference operation hour-minute, if the left schedule line is shifted to approach the right schedule line having a sufficient dwell time, the scheduling diagram is corrected such that the headway hour minute T1 of the critical path portion is reduced to a value T1' corresponding to the minimum value of the weight of the arrival/departure sequence arc, and the dwell time between the nodes B3 and B4 is maintained at "T2." In addition, unlike each node of the left schedule line. the execution timings of each node of the right schedule line are not changed even after the editing.

Figure 25:
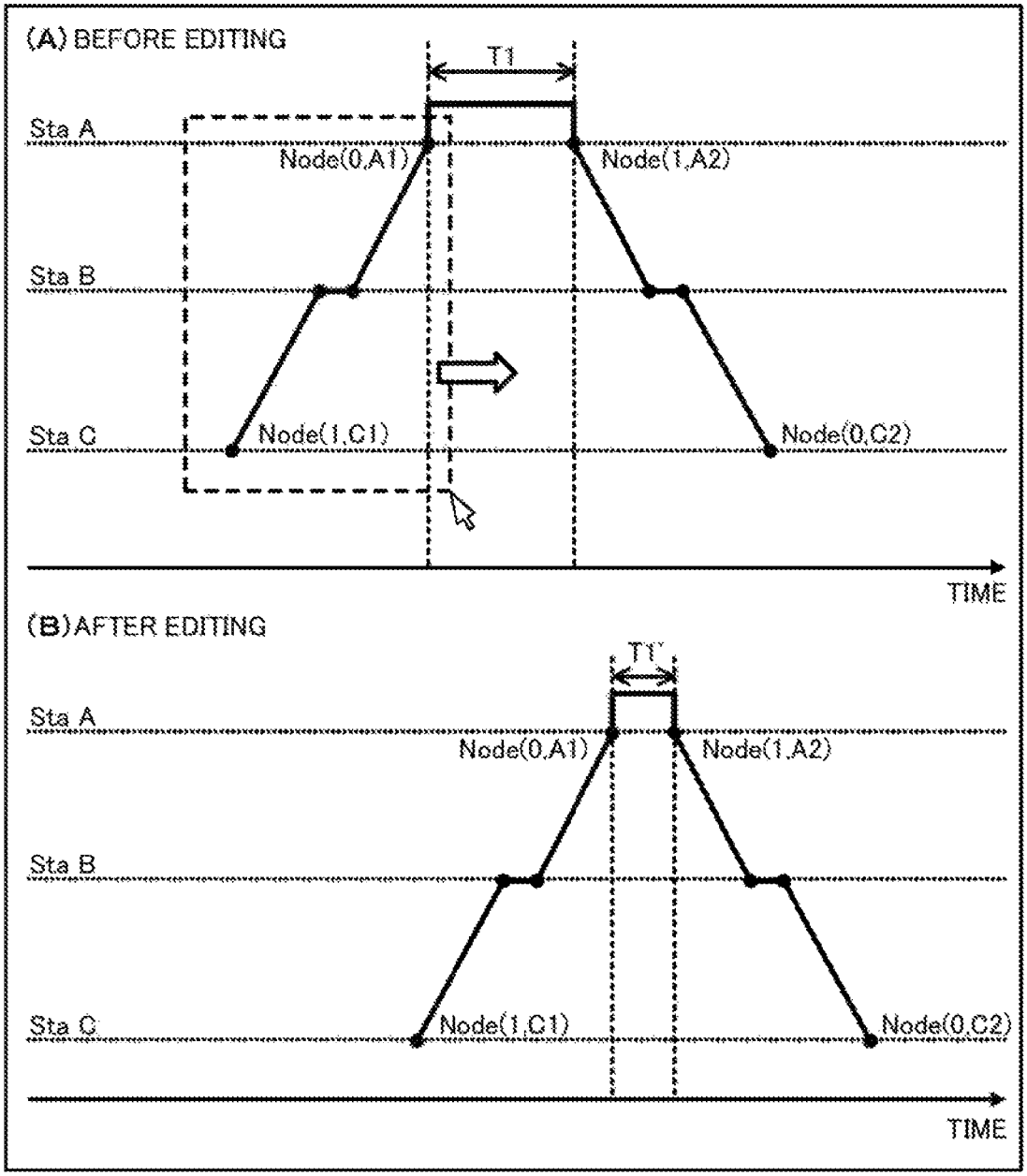
FIG. 25 illustrates a scheduling diagram editing example (5

FIG. 25 illustrates a scheduling diagram editing example (5). Here, FIG. 25 shows shifting of the schedule line when both the reference operation hour minute application mode and the turnaround hour/minute reduction allowance mode are selected. If a pair of schedule lines based on the reference operation hour/minute are connected to turn around at Station A, and the left schedule line indicated by the dashed line is shifted to approach the right schedule line having a sufficient turnaround time, the scheduling diagram is corrected such that the turnaround hour-minute T1 of the critical path portion is reduced to the minimum turnaround hour/minute T1'.

Figure 26:
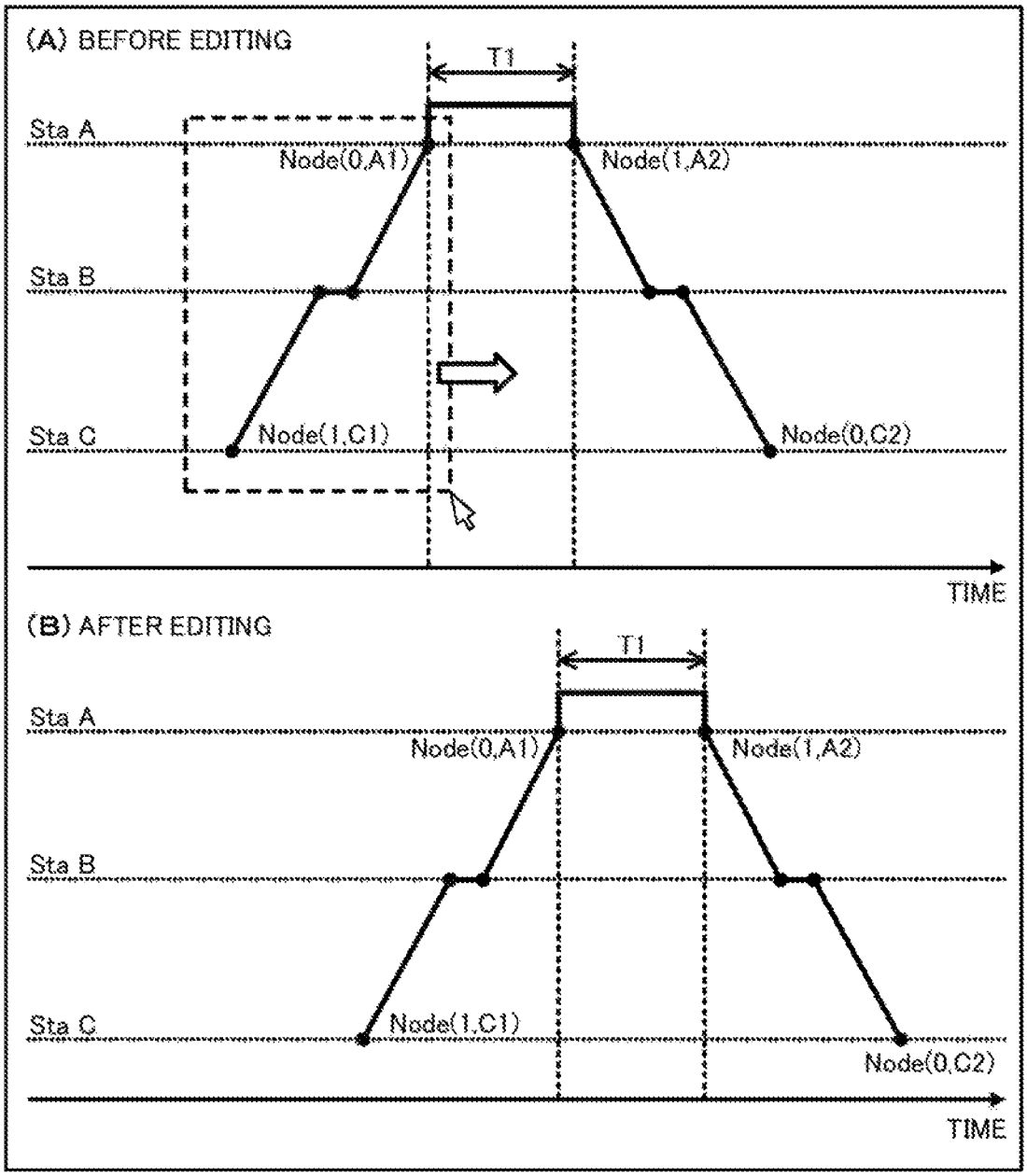
FIG. 26 illustrates a scheduling diagram editing example (6).

FIG. 26 illustrates a scheduling diagram editing example (6). Here, FIG. 26 shows shifting of the schedule line when the reference operation hour/minute application mode is selected, and the turnaround hour/minute reduction allowance mode is deselected. If a pair of schedule lines based on the reference operation hour/minute are connected to turn around at Station A, and the left schedule line indicated by the dotted line is shifted to approach the right schedule line having a sufficient turnaround time, the scheduling diagram is corrected such that the right schedule line is also shifted to the right while the turnaround hour/minute T1 of the critical path portion is maintained.

Figure 27:
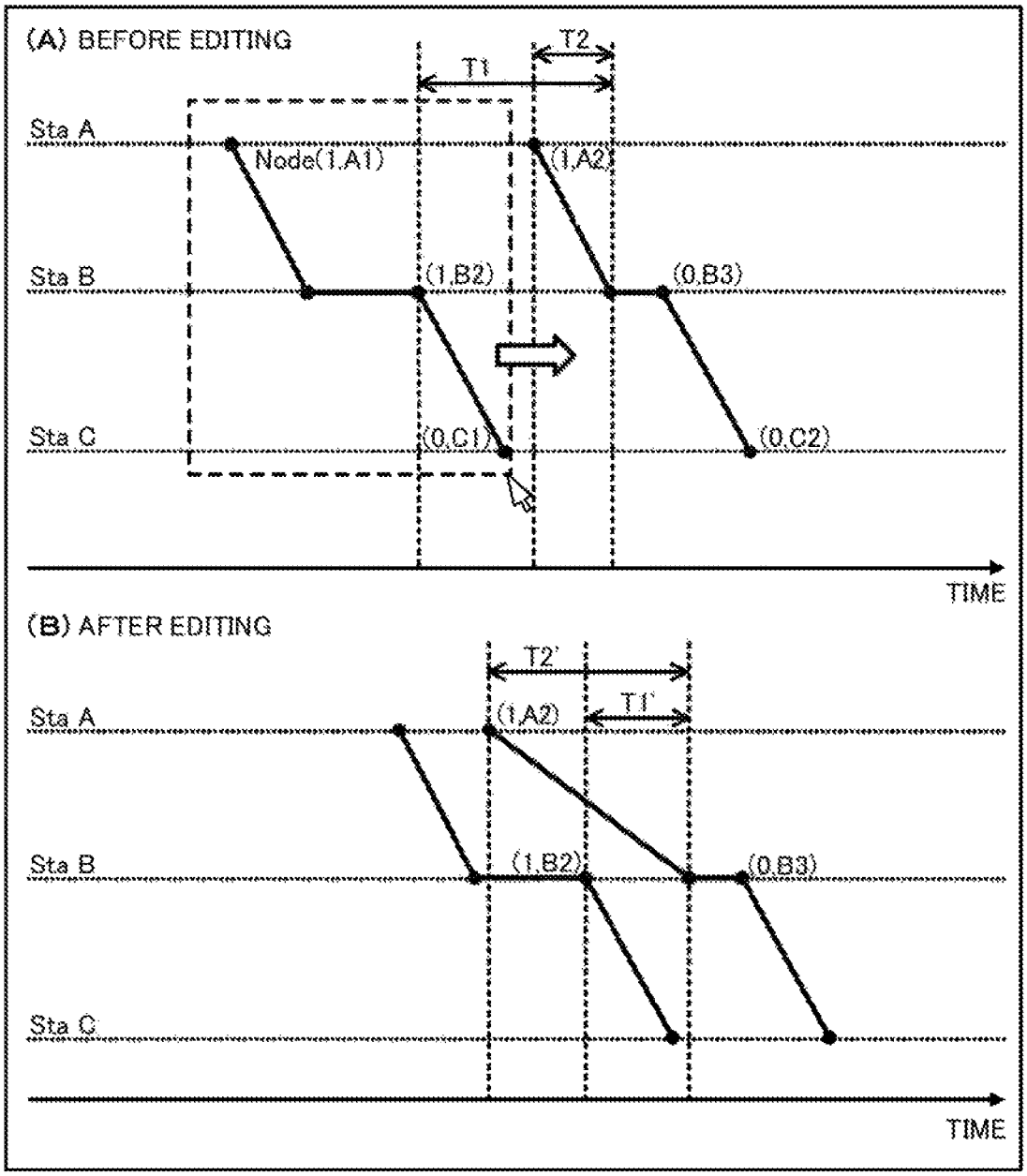
FIG. 27 illustrates a scheduling diagram editing example (7)

FIG. 27 illustrates a scheduling diagram editing example (7). Here, FIG. 27 shows shifting of the schedule line when the operation hour/minute delay allowance mode is selected, and the dwell hour/minute reduction allowance mode is deselected.

If a pair of schedule lines based on the reference operation hour/minute are provided, and the left schedule line is shifted to approach the right schedule line, the scheduling diagram is corrected such that the headway hour/minute T1 of the critical path portion is reduced to the time T1', and an operation hour/minute between the departure node A2 and the arrival node B3 of the right schedule line is lengthened from T2 to T2'. In addition, since the dwell hour/minute reduction allowance mode is deselected, the dwell time at Station B is maintained constantly.

In this manner, using the train scheduling diagram correction apparatus 1 according to this embodiment, even when a user shifts a schedule line on a screen, it is possible to limit the change such that a structure of the network diagram is not changed. Therefore, it is possible to change the scheduling diagram without influencing other operation schedules (such as a vehicle operation schedule, a staff management schedule, or a yard work schedule). For example, the train scheduling diagram correction apparatus 1 can be effectively applied when the scheduling diagram is revised, or when traffic is rearranged (when a trouble of the scheduling diagram is recovered from an accident), it is possible to automatically change arrival/departure timings of other relating trains by fulfilling predetermined constraint time requirements when it is demanded to change stopping stations or arrival/departure timings at main stations of a part of trains in consideration of convenient transfer to main trains of other routes.

<Modification>

Figure 28:
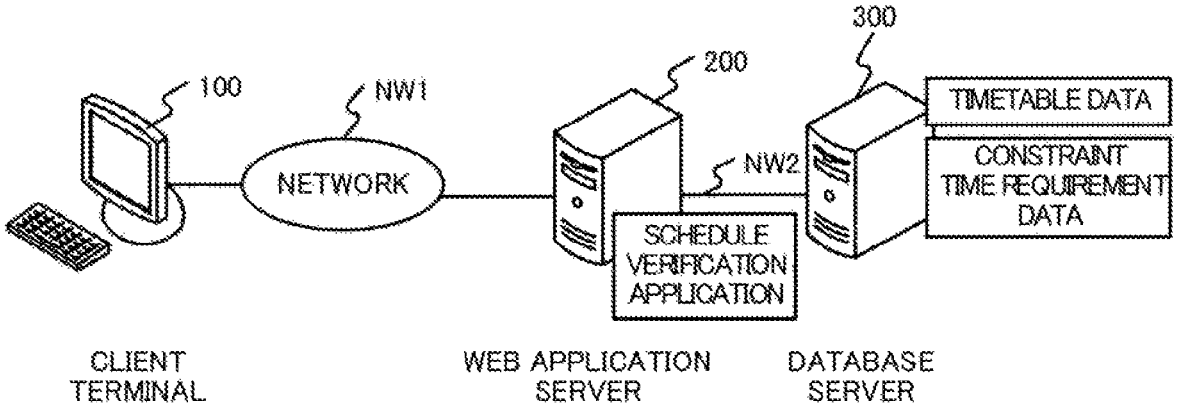
FIG. 28 illustrates a computer system as a modification of the train scheduling diagram correction apparatus of the embodiment.

FIG. 28 schematically illustrates a computer system as a modification of the train scheduling diagram correction apparatus according to the embodiment. In FIG. 28. a client terminal 100 is connected to a Web application server 200 through a network NW1 such as the Internet, and the Web application server 200 is connected to a database server 300 through a network NW2 such as a local area network (LAN). The client terminal 100 corresponds to the input unit 12 and the display unit 17 of FIG. 1. An application of the Web application server 200 corresponds to the schedule verification unit 14. The database server 300 corresponds to the timetable data memory unit 11 and the constraint time requirement data memory unit 13. In this manner, although overall components such as the timetable data, the constraint time requirement data, and the schedule verification unit are integrated into a single computer apparatus in the aforementioned embodiment, they may be distributed to several apparatuses such as the client terminal 100, the Web application server 200, and the database server 300 as illustrated in FIG. 28.

A scheme for converting the timetable data (schedule) into a network model is not limited to the PERT. Any scheme may also be employed as long as the earliest timing ET (lower-limit timing), the latest timing LT (upper-limit timing), and the minimum and maximum time intervals of each arc can be selected.

In the aforementioned embodiment, if a violation node is generated along with shifting of the schedule line, the schedule line is recovered to the previous original one, and the network diagram is displayed again. Alternatively, a user may be urged to correct by identifiable displaying a violation node while maintaining a shift state of the schedule line.

While several embodiments of the invention described hereinbefore are just for Illustrative purposes and are not intended to limit the scope of the invention. Those embodiments may be modified in various forms, and various omissions, changes, substitutions may also be possible without departing from the scope and spirit of the invention. The embodiments and their modifications are included in the scope and the spirit of the invention, which is to be given the full breadth of the appended claims and any and all equivalents thereof.

The invention claimed is:

1. A train scheduling diagram correction apparatus comprising:

a timetable data memory unit configured to store timetable data relating to a train traveling along a route obtained by sinking a plurality of stations;

a network diagram creating unit configured to read the timetable data from the timetable data memory unit, create nodes each representing an event relating to arrival and departure of the train in each station, and sequentially connect the nodes using arcs including an inter-station arc, a stopping arc, and an arrival/departure sequence arc, each representing a time interval between the nodes and a time-series arrival/departure sequence, in order to create a network diagram for visualizing the timetable data;

a display unit configured to display the network diagram created by the network diagram creating unit on a screen;

an input unit configured to select one of schedule lines included in the network diagram displayed on the display unit and input shift point information on a time-series sequence;

a constrains time requirement data memory unit configured to store minimum and maximum values of the time interval between the nodes as constraint time requirement data of the arc, and a network diagram update unit configured to correct a continuation headway indicating a time interval between a pair of the trains traveling along the same direction and a crossover headway indicating a time interval between a pair of the trains traveling oppositely with respect to a terminus station of the route on a schedule line placed in a schedule line shift direction on the basis of the constraint time requirement data relating to the corresponding nodes in response to the shift point information of the schedule line input from the input unit, in order to compute earliest and latest timings of the node on the schedule line placed in the shift direction and update the network diagram, wherein the network diagram creating unit is configured to set, for the node, an earliest timing constraint that defines a range for delaying a timing of initiating a daily train operation and a latest timing constraint that defines a range for expediting a timing of terminating the daily train operation, set, for the inter-station arc, an inter-station reference operation hour/minute defined in advance or a running hour/minute minimum headway between stations on the scheduling diagram as a running time minimum headway indicating a minimum value of the running time of the train between neighboring stations, set, for the inter-station arc, the reference operation hour/minute defined in advance or a running hour-minute maximum headway between the stations as a running time maximum headway indicating a maximum running time value of the train between the stations, set, for the stopping arc, a minimum dwell hour/minute defined in advance as a minimum dwelt lime headway indicating a minimum value of the dwell time elapsing from arrival of the train in a station to departure, set, for the stopping arc, a headway hour/minute defined in advance between a train and the next train as a first minimum headway indicating a minimum value of a first tune period elapsing from a departure timing of the train to an arrival timing of the next train in a particular platform of a certain station, set, for the stopping arc, twenty tour hours which is a maximum, value of a daily train operation time as a maximum dwell time headway indicating a maximum value of the dwell lime of the train and as a first maximum headway indicating a maximum value of the first tune period, set, for the arrival/departure sequence arc, the headway hour/minute defined in advance between a train and the next train as a second minimum headway indicating a minimum value of a second time period elapsing from an arrival timing of the train to an arrival timing of the next train in a certain station and as a third minimum headway indicating a minimum value of a thud time period elapsing from a departure timing of a train to a departure timing of the nest train in the station, and set, for the arrival/departure sequence arc, twenty four hours which is a maximum value of the daily train operation time as a second maximum headway indicating a maximum value of the second time period and as a third maximum headway indicating a maximum value of the third time period.

2. A train scheduling diagram correction apparatus comprising:

a timetable data memory unit configured to store timetable data relating to a train traveling along a route obtained by linking a plurality of stations;

a network diagram creating unit configured to read the. timetable data from the timetable data memory unit, create nodes each representing an event relating to arrival and departure of the train in each station, and sequentially connect the nodes using arcs each representing a time interval between the nodes and a time-series arrival/departure sequence in order to create a network diagram for visualizing the timetable data;

a display unit configured to display the network diagram created by the network diagram creating unit on a screen;

an input unit configured to select one of schedule lines included in the network diagram displayed on the display unit and input shift point information on a time-series sequence;

a constraint time requirement data memory unit configured to store minimum and maximum values of the time interval between the nodes as constraint time requirement data of the arc; and a network diagram update unit configured to correct a running hour/minute of the same train between a pair of neighboring stations on a schedule line placed in a schedule line shift direction on the basis of the constraint tune requirement data of arcs relating to the corresponding nodes in response to the shift point information of the schedule line input from the input unit, in order to compute earliest and latest timings of the node on the schedule line placed in the shift direction and update the network diagram.

3. The train scheduling diagram correction apparatus according to claim 2, wherein the network diagram update unit corrects a dwell time and a turnaround time of the same train in addition to the running hour/minute on the basis of the constraint time requirement data of arcs relating to the corresponding nodes in response to the shift point information of the schedule line input from the input unit, in order to compute earliest and latest timings of the node on the schedule line placed in the shift direction and update the network diagram.

4. The train scheduling diagram correction apparatus according to claim 1, wherein the network diagram update unit corrects a running hour/minute of the same train between a pair of neighboring stations and dwell and turnaround times of the same train in addition to the continuation headway and the crossover headway on the basis of the constraint time requirement data of arcs relating to the corresponding nodes in response to the shift point information of the schedule line input from the input unit, in order to compute earliest and latest timings of the node on the schedule line placed in the shift direction and update the network diagram.

5. A program embodied on computer-readable media to execute a train scheduling diagram correction method, the method comprising:

a network diagram creation process reading timetable data relating to a train traveling along a route obtained by linking a plurality of stations from a memory device that stores the timetable data, creating nodes each representing an event relating to arrival and departure of the train in each station, and sequentially connecting the nodes using arcs each representing a time interval between the nodes and a time-series arrival/departure sequence in order to create a network diagram for visualizing the timetable data;

a display process displaying the network diagram created through the network diagram creating process on a screen;

a shift point input process selecting one of schedule lines included in the network diagram displayed in the display process and inputting shift point Information on a time-series sequence, and a network diagram update process correcting a continuation headway indicating a time interval between a pair of the trains traveling along the same direction, a crossover headway indicating a time interval between a pair of the trains traveling oppositely with respect to a terminus station of the route, a running hour-minute of the same train between a pair of neighboring stations, and dwell and turnaround times of the same train on a schedule line placed in a schedule line shift direction on the basis of constraint time requirement data obtained by defining minimum and maximum values of the time interval between the corresponding nodes in advance in response to the shift point information of the schedule line input in the shift point input process, in order to compute earliest and latest timings of the node on the schedule line placed in the shift direction and update the network diagram.

* * * * *